US006332292B1

(12) United States Patent
Buzon

(10) Patent No.: US 6,332,292 B1
(45) Date of Patent: Dec. 25, 2001

(54) DEVICE FOR ADJUSTING INCLINATION WHEN BUILDING ON BLOCKS

(75) Inventor: Claude Buzon, Herstal (BE)

(73) Assignee: Buzon Pedestal International, Herstal (BE)

( * ) Notice: Subject to any disclaimer, the term of this patent is extended or adjusted under 35 U.S.C. 154(b) by 0 days.

(21) Appl. No.: 09/529,975

(22) PCT Filed: Oct. 30, 1998

(86) PCT No.: PCT/BE98/00165

§ 371 Date: Apr. 24, 2000

§ 102(e) Date: Apr. 24, 2000

(87) PCT Pub. No.: WO99/23327

PCT Pub. Date: May 14, 1999

(30) Foreign Application Priority Data

Oct. 31, 1997 (BE) ..... 09700878

(51) Int. Cl.[7] ..... E04B 9/00
(52) U.S. Cl. ..... 52/126.6; 248/351
(58) Field of Search ..... 248/351, 357, 248/188.2, 188.4; 52/126.6, 126.5, 126.1

(56) References Cited

U.S. PATENT DOCUMENTS

| | | | | |
|---|---|---|---|---|
| 3,318,057 | | 5/1967 | Norsworthy | 52/126.6 |
| 4,439,961 | * | 4/1984 | Witte | 52/126.6 |
| 4,558,544 | * | 12/1985 | Albrecht et al. | 52/126.6 |
| 5,442,882 | | 8/1995 | Rapasky | 52/126.6 |
| 5,970,665 | * | 10/1999 | Oudman | 52/126.6 |

FOREIGN PATENT DOCUMENTS

| | | |
|---|---|---|
| 606701 | 11/1978 | (CH) . |
| 3709017 | 10/1988 | (DE) . |
| 4420807 | 12/1995 | (DE) . |
| 985148 | 3/1965 | (GB) . |
| 1238463 | 7/1971 | (GB) . |

* cited by examiner

*Primary Examiner*—Ramon O. Ramirez
(74) *Attorney, Agent, or Firm*—Dykema Gossett PLLC

(57) ABSTRACT

A device for adjusting the inclination of a building surface, the device having two mutually cop-operating adjusting elements. The first element is for establishing an initial angle α and the second adjusting element is moved between an initial position and operational position selected by the user depending on the slope to be given to the building surface. The second adjusting element is selectively adjustable relative to the first adjusting element and thereby produces the slope required for the building surface by positioning the second element with respect to the first by mutual rotation. The device also has an adjusting means for making each mutual position corresponding to an adjusting angle α.

22 Claims, 23 Drawing Sheets

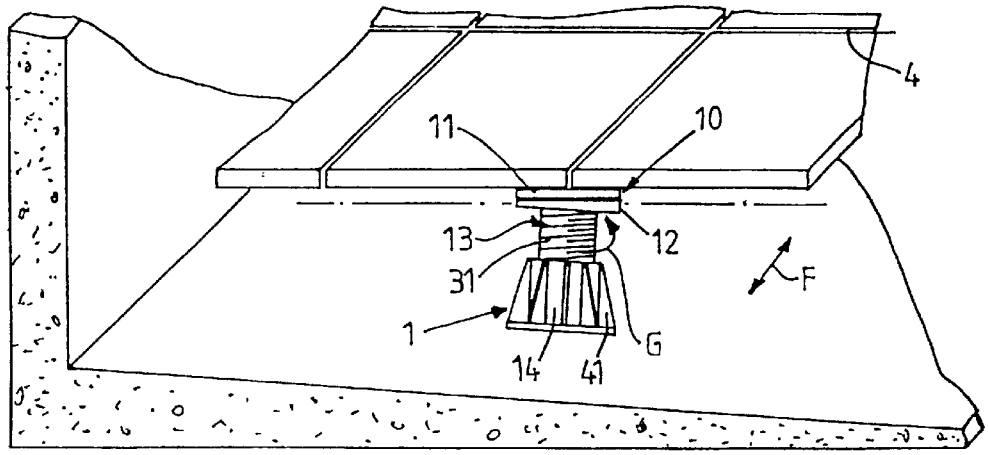
Fig. 2B
Fig. 4
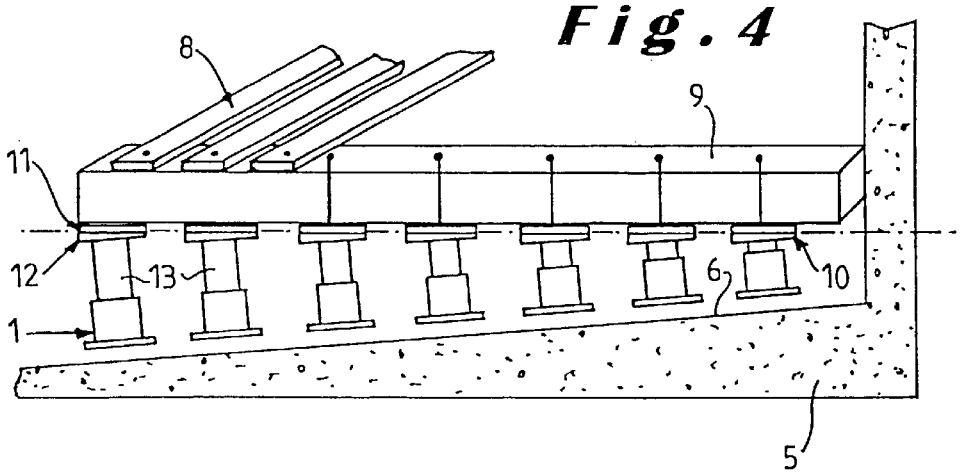
Fig. 5
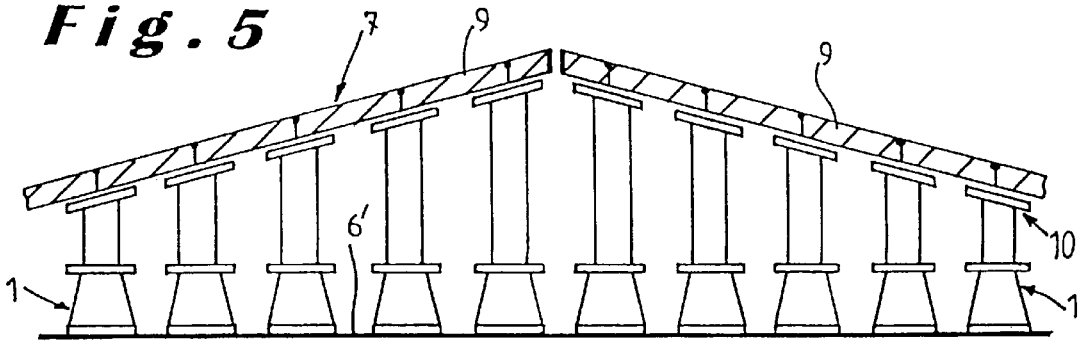

DEVICE FOR ADJUSTING INCLINATION WHEN BUILDING ON BLOCKS

FIELD OF THE INVENTION

The present invention relates to a device for adjusting the inclination of a surface for building on blocks, comprising an element for elevating the building surface, this element having a base surface and a top surface forming a support surface for the building surface.

DESCRIPTION OF RELATED ART

It is a known practice to use blocks in order to obtain raised floors. However, when raised building surfaces are formed, for example, on a terrace, these are arranged in a horizontal plane, while the underlying floor surface, for its part, is at a certain slope so as to allow rainwater and/or upkeep water, etc. to run away.

To convert this slope into a raised horizontal plane, it is a known practice to use shims which are placed under or on the block. To level the block to horizontal, shims of different thicknesses have to be placed under the base of the block. Additional shims 1 to 2 mm thick have to be placed on the top of the block to make fine adjustments according to the quality of the thickness of the slab.

However, the result obtained is not satisfactory because the positioning of these shims adopts a rather random nature and takes a great deal of time. There is also a problem in the case of repairs, because it is difficult to reposition a shim after the repair in the same position as it had before the repair.

BRIEF SUMMARY OF THE INVENTION

The object of the present invention is to overcome these problems.

By virtue of the device according to the invention, it is contrived that, with a sloping initial floor, the top of the block can be set to horizontal using a very simple system without the need to resort to inaccurate shims while at the same time making savings in labour.

Another advantage afforded by the device according to the invention is in the fact that, starting out with a horizontal floor, it is possible to create a sloping floor structure and thus produce a new sloping roof structure on an existing roof.

Thus, the device according to the present invention makes it possible to support raised slabs or floor structures or any other system placed on a sloping floor in the construction and to level it to horizontal. This device, placed on a sloping floor, can be adjusted in terms of height and the top of the device can be set to horizontal to level out slopes of up to 5%, namely 0 to 5 cm/m, and even more.

Thus, by virtue of the invention, there is the possibility of creating floors with slopes ranging to as much as 5 cm per meter, and even more. In known devices, the block is levelled to horizontal using shims under the base of the block and shims on the top of the block. Using the new adjustable system, the spacer piece is placed on the top of the block 13 and the adjustment to horizontal is simplified.

The radial and circular bars allow the angle to be adjusted gradually by continuous mutual rotation of the two discs.

Another significant advantage of the device consists in the fact that the slope can be altered simply by rotating the top part without the need to raise or remove the two spacer pieces and even without having to remove the block under the slab.

Yet another advantage of the device results from the fact that the block can be positioned in the direction of the slope and that the horizontality of the raised surface can thus be found immediately, thus affording an adjusting means which is both reliable and quick. By virtue of the device, the amount of levelling required is actually known directly, without this having to be found, thus affording immediate orientation.

The rules of the art demand minimum slopes of 2% or more and this makes it possible to conceive of steeper slopes for:

- roofing accessible without stagnation or significant soiling under the slabwork;
- technical floors in the chemical and other industries requiring a containment tank for removing dangerous liquids to collectors in the event of an accident; and
- the renovation of various floors for which it is no longer necessary to reproduce a concrete floor, thus leading to a saving in materials and labour before installing the new raised floor, for example in offices, attics, cellars and old buildings.

The composition of the device depends on its use and it is made by injection moulding of blackcoloured plastic made of polypropylene or polystyrene or high-density polyethylene, or of polycarbonate or polyester with or without glass fibres, with or without fire-resistant and self-extinguishing additives and/or other synthetic materials. It may also be made by casting out of aluminium or steel and/or stainless steel.

The values of the slope are indicated in the top piece, thus making the device extremely convenient to use because all that is required is for the values shown to be read off. Furthermore, the device according to the invention can be fitted onto a flat-topped cylinder. Advantageously, the device can be clipped onto the block and the assembly does not become detached, which is extremely convenient on the building site. The two parts (upper and lower) of the device clip together and are therefore attached.

BRIEF DESCRIPTION OF THE DRAWINGS

Other advantages and details will become apparent from the description given hereinafter of a few exemplary embodiments of a device according to the invention, with reference to the appended drawings.

FIGS. 2A, 2B and 3 are perspective views of a device according to the invention in its general application.

FIG. 4 is a perspective view of the device in use.

FIG. 5 is a side elevation view of the device in use.

DETAILED DESCRIPTION OF THE INVENTION

In the description hereinbelow, the device according to the invention is known by the term "double spacer piece".

Figure 2A:
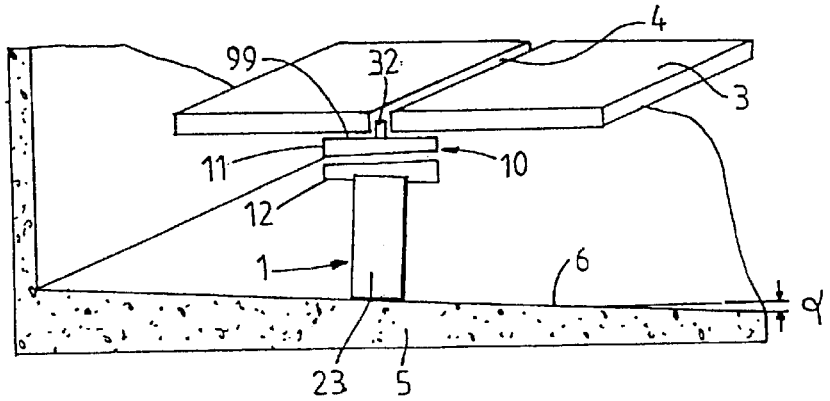
Figure 1:
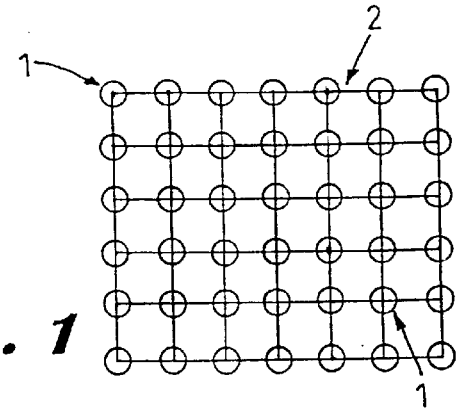
FIG. 1 is a diagrammatic view of a slabwork surface on blocks.

FIG. 2A illustrates a view of a collection of a number of slabs laid on a double spacer piece 10 clipped onto fixed-height cylinders 23 acting as support for the slabs and placed on a sloping floor 5. The surface 2 of the slabs 3 is horizontal by virtue of the double spacer piece adjusting device 10.

FIG. 2B illustrates a view similar to FIG. 2A, but with the double spacer piece 10 arranged on a height-adjustable block 1.

Figure 3:
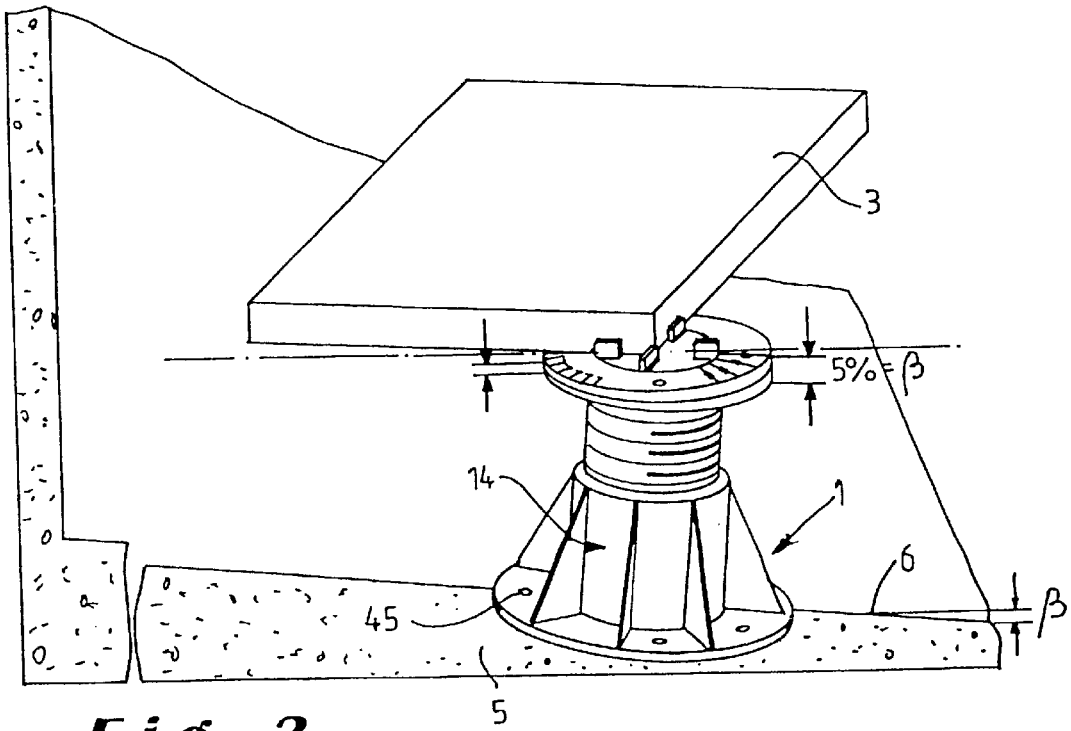

FIG. 3 illustrates another view, similar to the previous views, of the spacer piece 10 on an adjustable block 1 supporting a slab 3 on a floor.

FIGS. 4 and 5 each illustrate a view of the spacer piece 10 on adjustable blocks 1 supporting beams 9 arranged in a chevron formation on a sloping floor 6, allowing the formation of a floor structure 8, and, respectively, on a horizontal floor 6, allowing the formation of a sloping roof 7.

Figure 6:
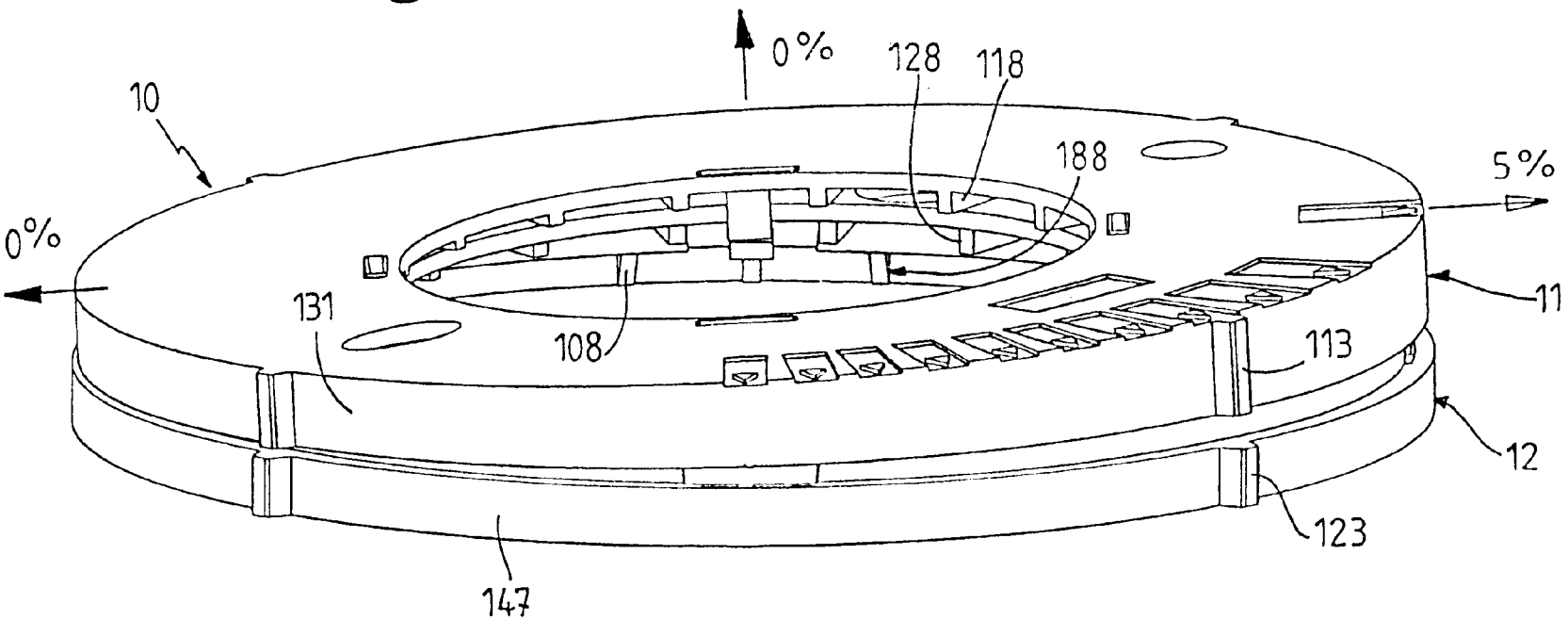
FIG. 6 is a perspective view of a first embodiment of the device according to the invention.

FIG. 6 illustrates a view of the assembly 10 consisting of two spacer piece parts 11, 12, clipped together in a respective position which creates a certain slope and, more specifically, in the example illustrated here, a slope at 50, namely 5 crn/m in a horizontal view from left to right in the drawing.

Figure 8:
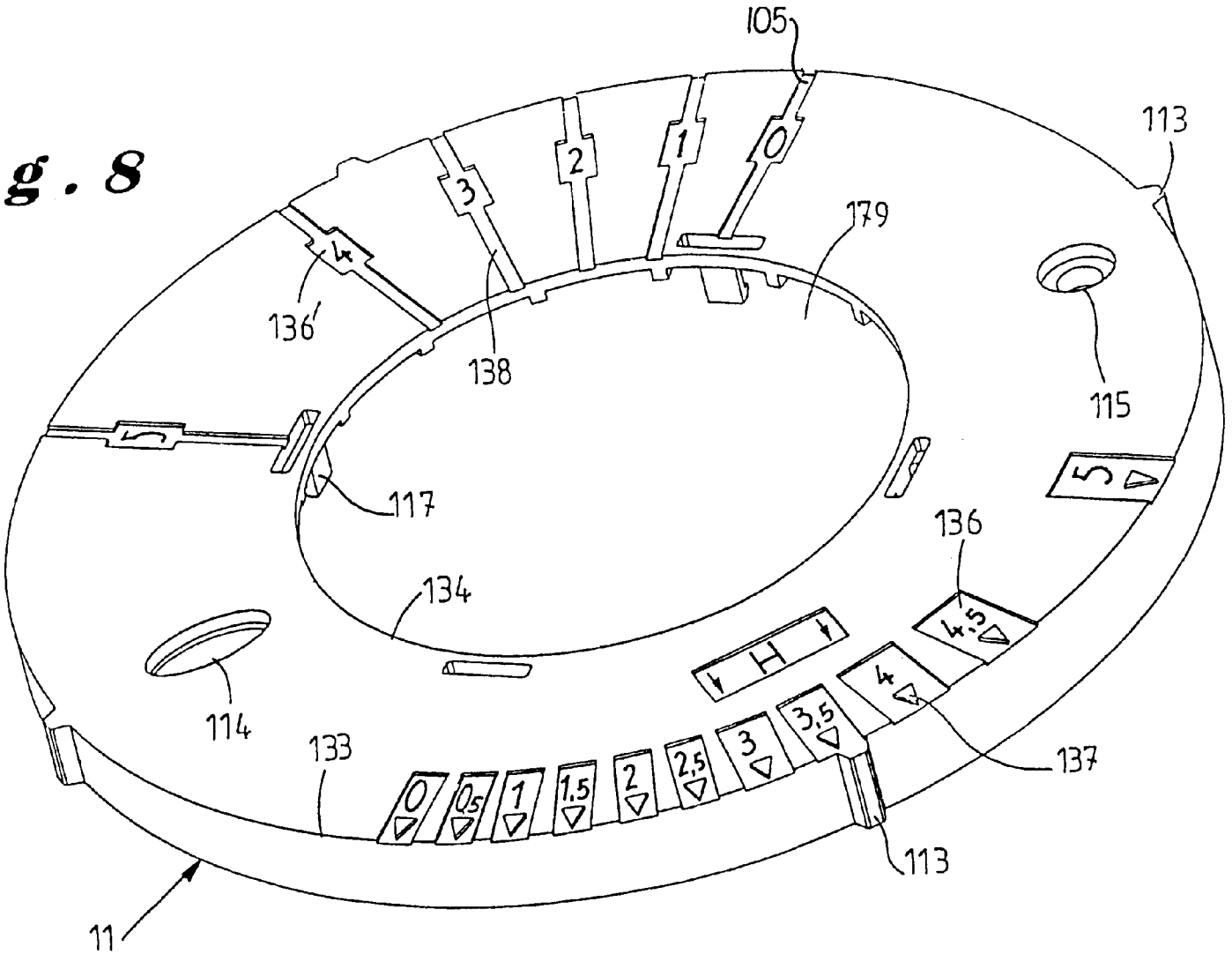
FIG. 8 is a perspective view from above of the top piece of the device according to FIG. 7.

FIG. 8 shows marked locations consisting of rectangles 136 in which the various values ranging from 0 to 5 cm/m are written, indicating the direction of the slope that is to be levelled or of the slope that is to be created in the direction of the arrow. A locking orifice 115 is made in the top piece 11 to lock the bottom piece 12 using a pin 122. An oval opening 114 in the top piece 11 is used to look on the bottom piece 12 for the prescribed value of the initial slope given by rotating the top piece 11 on the bottom piece 12.

Furthermore, lugs 117 are provided on the periphery of the central opening 179 in the top piece 11 for clipping the top piece 11 onto the bottom piece 12. To allow perfect alignment of the direction of the block with the slope that is to be levelled and/or created, additional identification points 136' are advantageously provided on the top part 11. These 136' are arranged in line with the aforementioned points 136, diametrically opposite.

Figure 9:
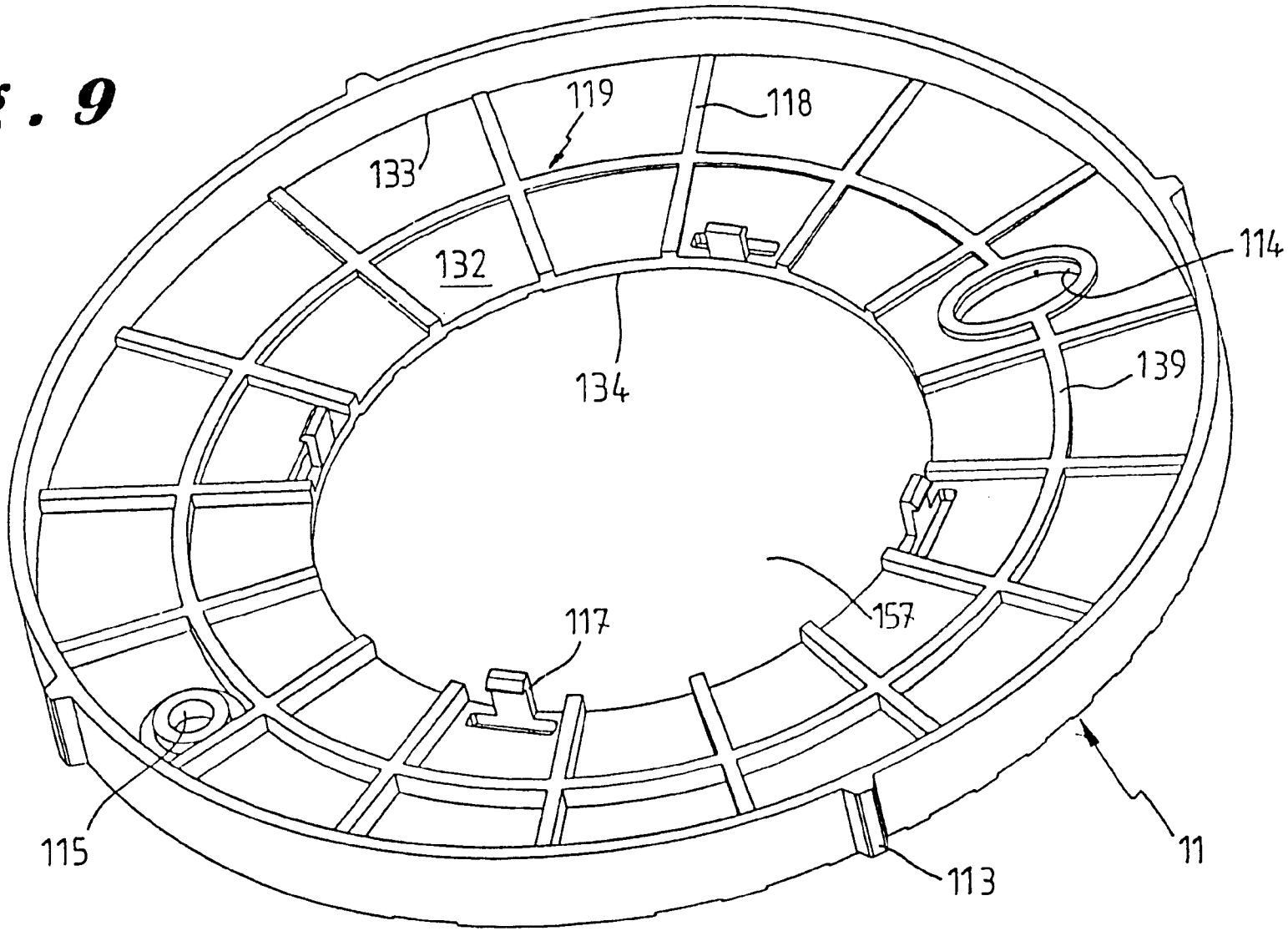
FIG. 9 is a perspective view from below of the top piece according to the previous figure.

FIG. 9 shows sixteen radial bars 118 of different thicknesses, increasing uniformly between a minimum and a maximum thickness value corresponding respectively to an adjustment from 0 to 50 or from 0 to 5 cm/m by rotating the top disc 11 on the surface of the bottom disc 12.

Figure 10:
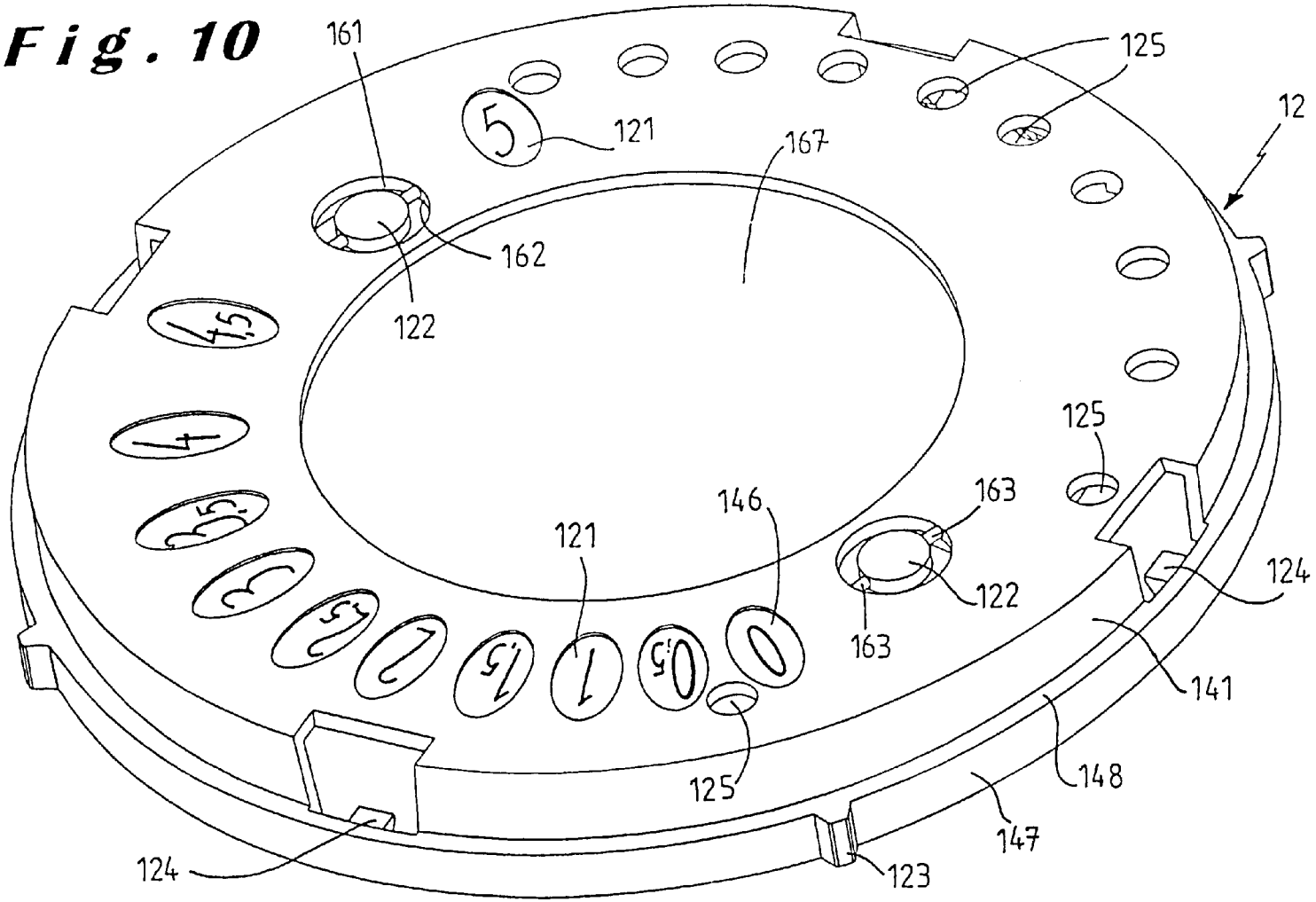
FIG. 10 is a perspective view from above of the bottom piece of the device according to FIG. 7.

FIG. 10 shows places 121 reserved for reading, which are provided on the bottom disc 12, and in which the prescribed values of the slope to be levelled, ranging from 0 to 5 cm/m in the example described here, are written.

Figure 11:
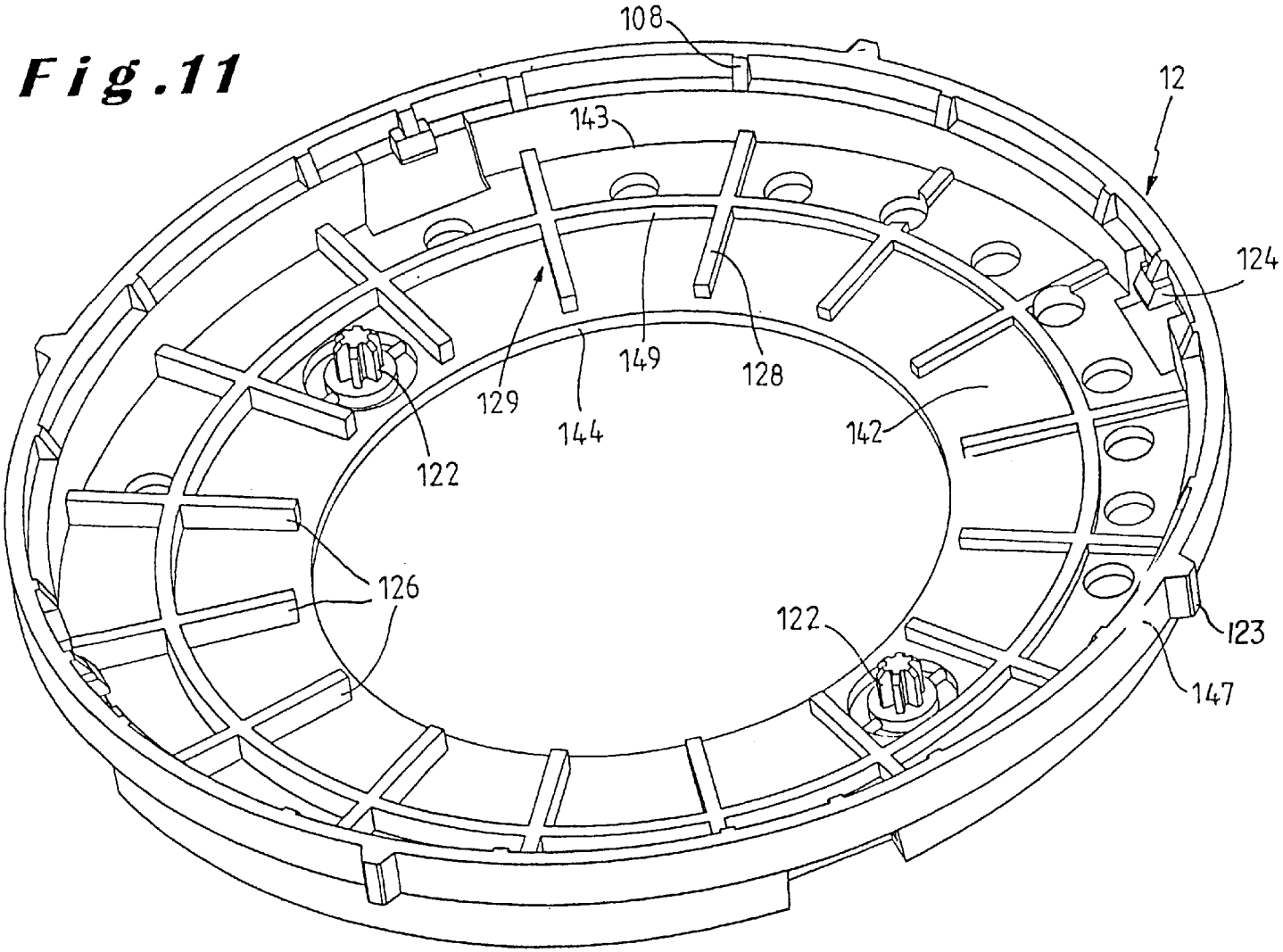
FIG. 11 a view from below of the bottom piece of the device according to the previous figure.

Two locking pins 122 are advantageously incorporated into the bottom spacer piece 12, as shown in FIG. 11. They can be detached by braking the connecting strips 163.

Similarly, sixteen radial bars 126 of different thicknesses are provided here for adjustment from 0 to 5% allowing the bottom disc 12 to be adjusted by rotation on a cylindrical support 23 or the cylindrical top 13 of a block. The radial bars 118 of FIG. 9 have the same respective thicknesses of each of the radial bars 126 in FIG. 10.

Figure 14:
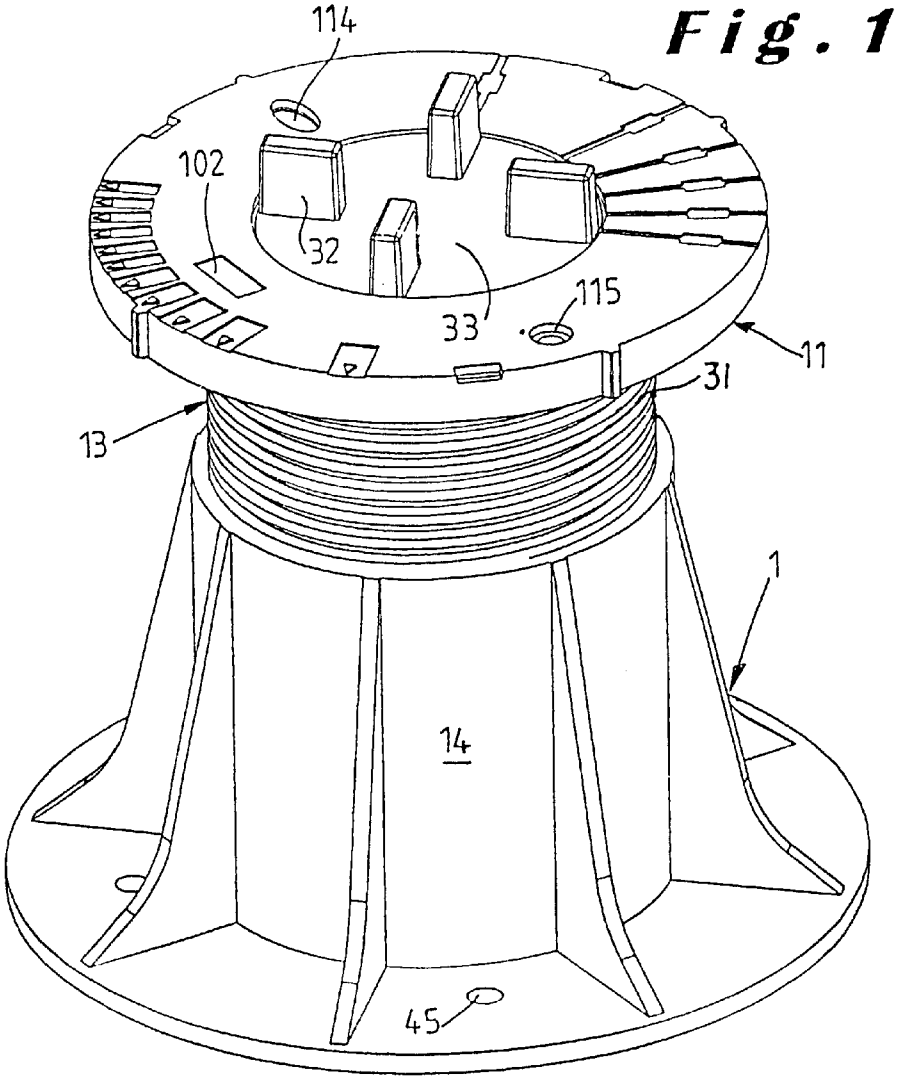
FIG. 14 is a perspective view of the device as used with a block.

Clipping lugs 124 are provided on the periphery of the rim 147 of the skirt 141 (FIG. 10) for attaching the bottom disc 12 to a cylindrical support 23 or to the cylindrical top of an adjustable block 13 (FIG. 14).

Figure 11A:
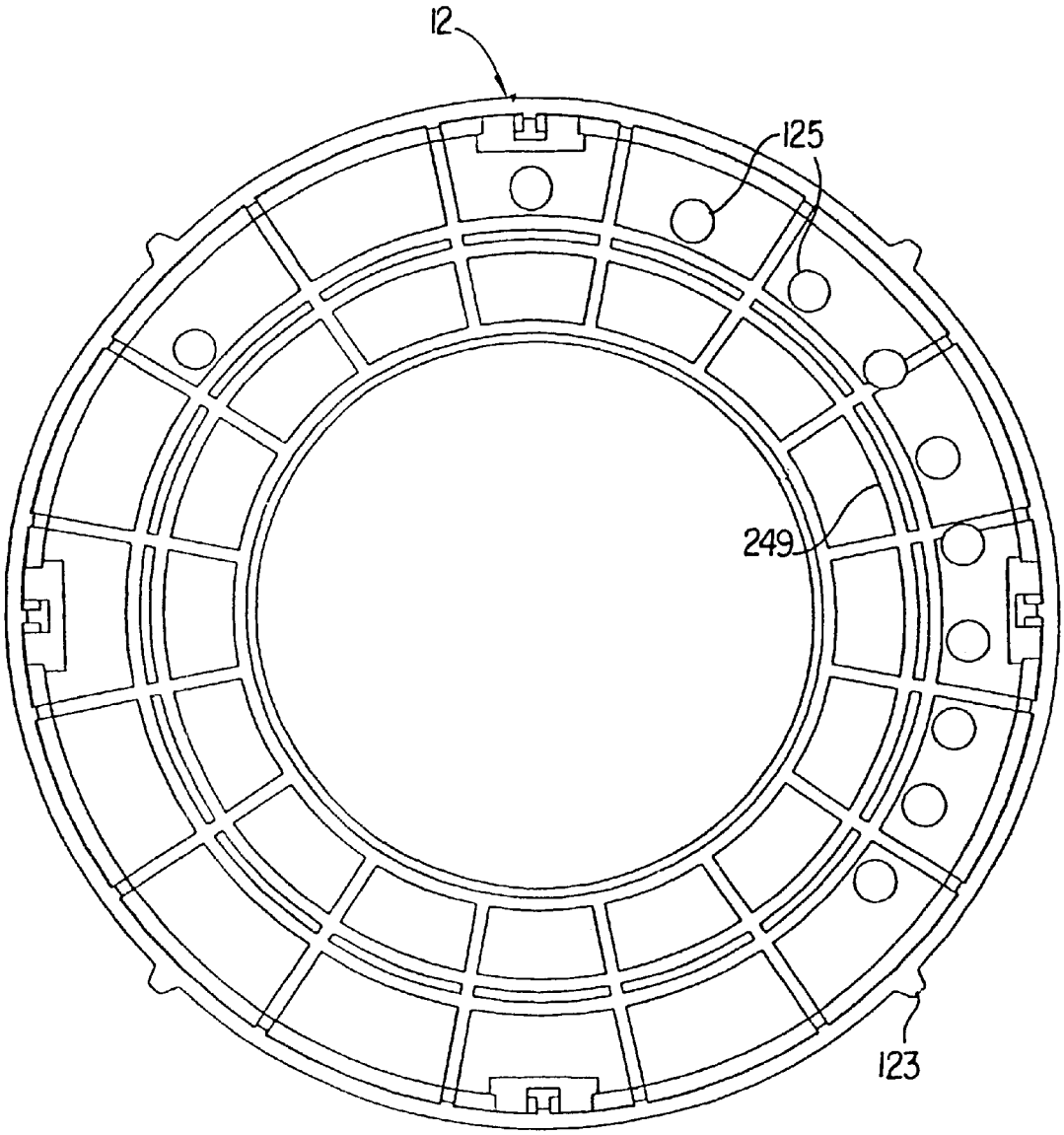
FIG. 11A is a bottom plan view of the bottom piece of the device.

As shown in FIG. 11A, eleven housing orifices 125 are made in the bottom piece 12 for locking together the two discs 11 and 12 of the block using one of the aforementioned pins 122.

External bumps 123 are also provided on the periphery 147 of the external peripheral skirt 141, to allow a good grip for the lateral rotation through 360° of the two assembled parts 11, 12 secured to the cylindrical support 23 or to the top of the adjustable block 13.

Inclined guide elements 108 are provided on the internal periphery of the rim 147 of the skirt 141 of the bottom piece 12 to make it easier to fit the spacer piece assembly 10 onto a cylindrical support 23 or the top of an adjustable block 13.

The device, when in place on a stationary or height-adjustable cylindrical support, makes it possible to support raised slabs or floor structures or any other system placed on a sloping floor, particularly in the field of building, and to level it to horizontal. This device also makes it possible, starting out with a horizontal floor, to create a sloped surface by placing this device on a fixed or height-adjustable cylindrical support.

In general, the device for adjusting the inclination of a building surface 2 on a block 1 comprises an element 1 for raising the said building surface 2 which has a base surface 91 and a top surface 92 forming a support surface of the said building surface. It comprises at least one adjusting and/or pre-adjusting element 11, 12, respectively, which are intended to collaborate with each other. The first element 12 makes it possible to set the initial angle a of the aforementioned inclination, while the second aforementioned adjusting element 11 may be moved between an initial rest position and an operational position chosen by the user according to the slope to be conferred upon the said building surface. The second adjusting element 11 is orientable selectively with respect to the first aforementioned adjusting element 12 so as to create the desired slope for the aforementioned building surface 2 by positioning the second aforementioned adjusting element 11 with respect to the said first adjusting element 12 by rotating the said second element 11 with respect to the first 12. Remarkably, the aforementioned elements 11, 12 have adjusting means 119; 129 which cause an angle of adjustment to correspond to each position of this element with respect to the first aforementioned element 12.

Each aforementioned adjusting element 11; 12 consists of a disc with a peripheral rim 131, 141 forming a skirt allowing the said adjusting pieces 11, 12 to fit together, advantageously by clipping together.

The aforementioned adjusting means 119, 129 comprise bars 118, 128 extending more or less radially across the interior surface 132, 142 of the disc 11, 12.

The radial bars 118, 128 remarkably have a height which varies in a practically linear fashion between a minimum value corresponding to the reference angle and a maximum angular-adjustment value. Furthermore, they are spaced an approximately constant distant apart.

The aforementioned adjusting means 119, 129 comprise at least one circular rib 139, 149 running concentrically on the interior surface 132, 142 of the disc 11, 12. The aforementioned circular rib 139, 149 is provided midway between the outer 133, 143 and inner 134, 144 edges of the discs. As a preference, the height varies in a practically linear fashion between a minimum value corresponding to the reference angle and a maximum angular-adjustment value.

Each circular rib 139, 149 intersects the radial bars 118, 128 at practically a right angle and at the same height, so as to allow one piece 11 to be rotated continuously on the other 12.

The double cylindrical spacer piece device 10 is formed of two discs 11, 12 which, by rotating one of them with respect to the other on a cylindrical support 1 of the same diameter makes it possible, thanks to a spacer piece height gradient in a clearly defined direction, to obtain slopes $\alpha$ from 0 to 50 and/or to level out slopes $\beta$ from 0 to 5% each corresponding to a value of between 0 and 5 cm/m.

However, the device offers spacer pieces 11, 12 of different sizes and thicknesses for steeper slopes.

Figure 9A:
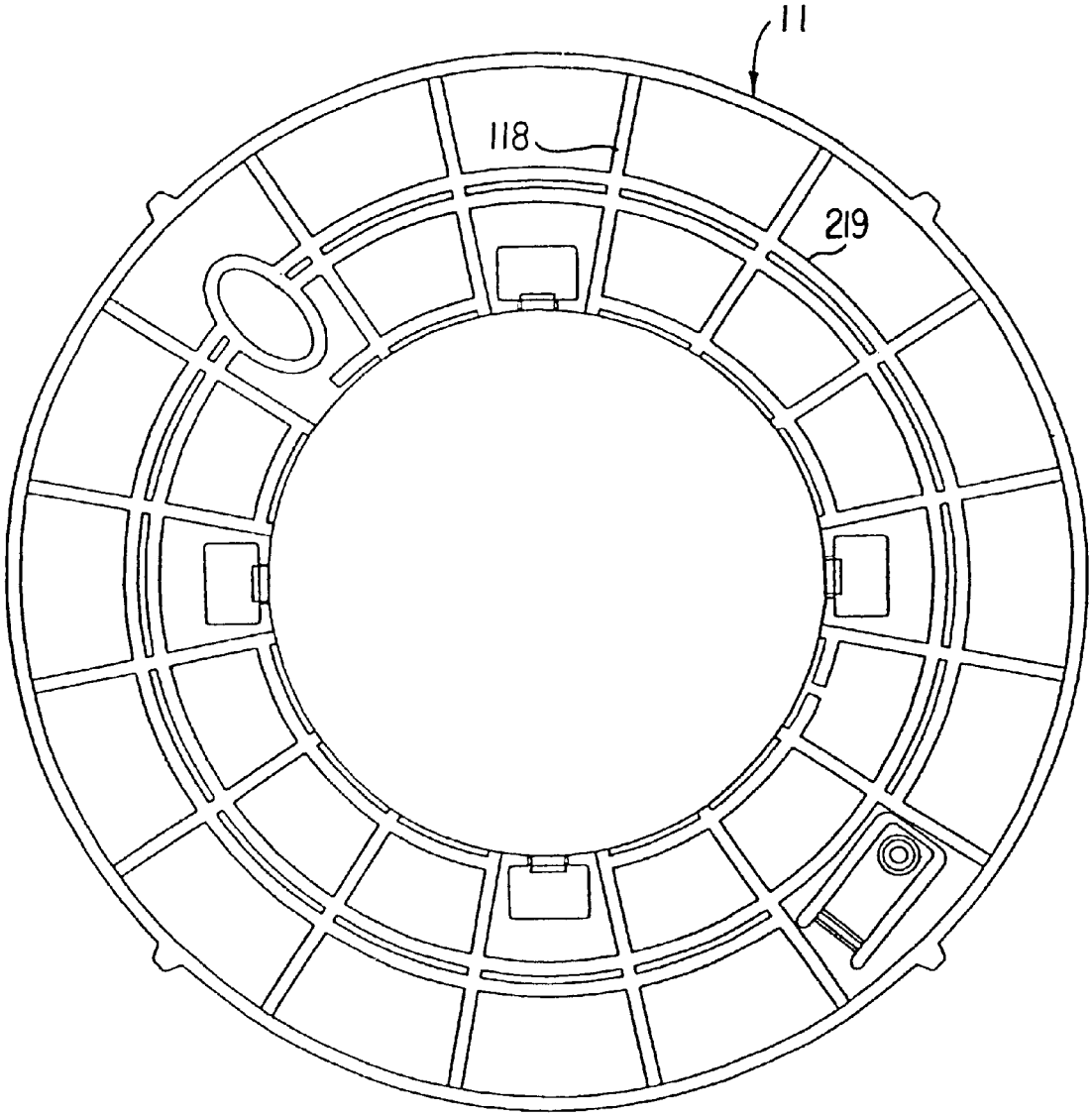
FIG. 9A is a bottom plan view of the top piece of the device.

Advantageously, an additional circular rib 219, 249 may be provided, as visible in FIGS. 9A and 11A, thus providing more reinforcement.

Thus, it is possible, by means of a fixed or height-adjustable cylindrical support:

starting out with a floor at a slope of from 0 to 5 cm/m, to obtain a perfectly horizontal raised floor or slabwork;

starting out with a horizontal floor, to achieve a sloping raised floor or a roof made of stainless steel, zinc (on a wooden framework) and/or an access floor sloping by 0 to 5%, that is to say by 0 to 5 cm/m in any direction.

Figure 7:
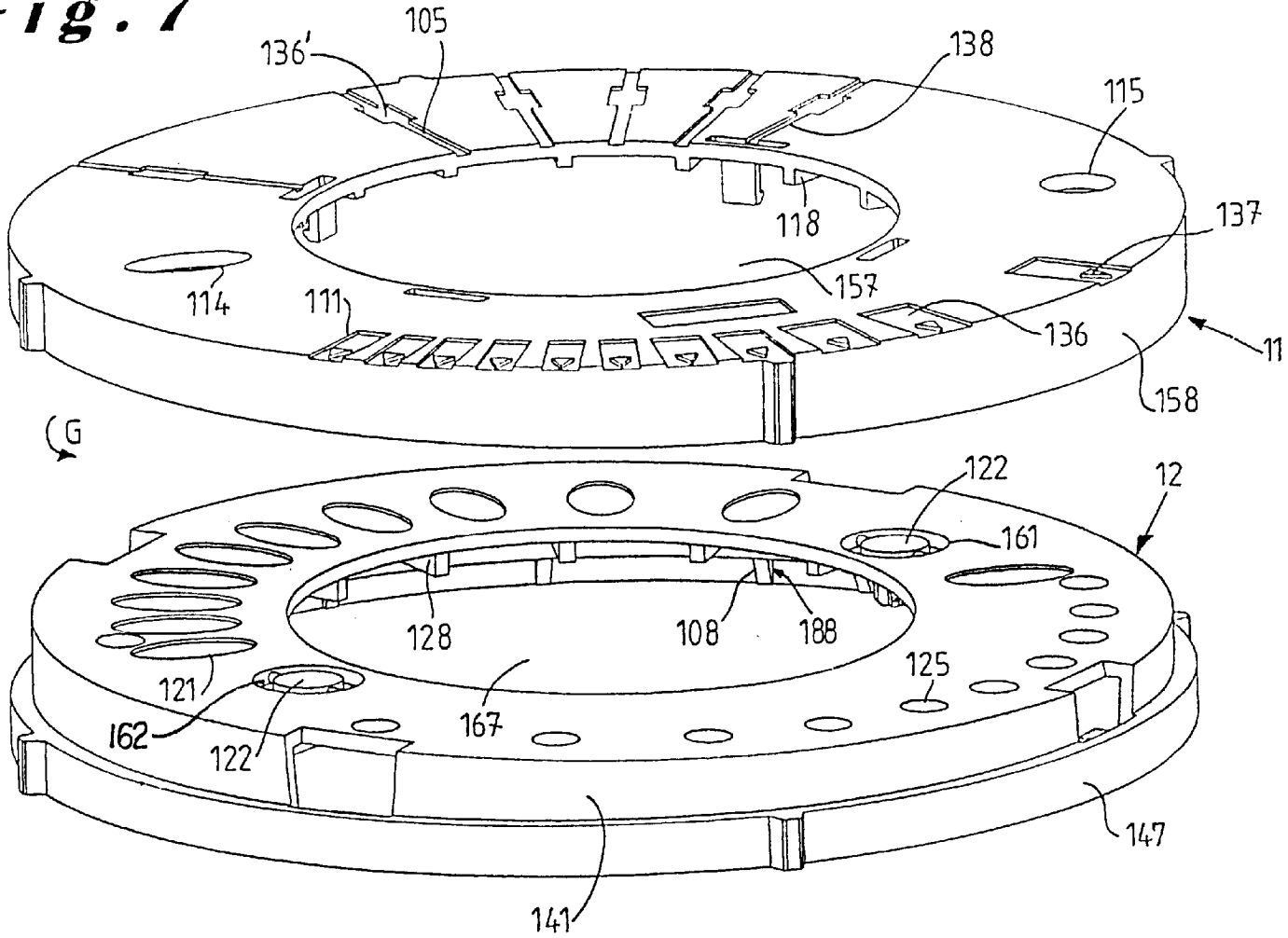
FIG. 7 is an exploded view of the two pieces according to FIG. 6.

Each disc 11, 12 has a reserved area comprising a predetermined number of spaces 111, 121 (FIG. 7) extending in turn overpart of the disc 11, 12, each space 111, 121 corresponding to a given angle of adjustment $\beta$. Each space 111 or 121 has an identification element 136, 146 allowing identification of the angle of adjustment a to be provided. The spaces 111 of the sighting adjusting disc 11 have an additional identification element 137 (FIG. 8) for indicating the direction of the actual slope present on the site.

Each of the aforementioned reserved areas extends over less than half of the disc 11, 12.

The primary spaces 111 of the primary disc 11 are supplemented by secondary spaces 105 provided on the diametrically opposite side of the disc 11, more or less in line with these 111, in a secondary reserved area, so as to allow additional visual alignment for the user when adjusting at the time of laying. The secondary spaces 105 extend from one edge 133 of the disc 11 to the other 134, in a more or less radial direction, each one 105 having identification elements 136' corresponding to those 136 of the primary area.

The aforementioned identification elements 136, 136'; 146 are formed of the reference figures for the angle a to be provided.

The primary area is set out near the outer edge 133 of the disc 11, the additional identification elements 137 being formed of arrows located in close proximity to the said outer edge and pointing outwards.

The disc 11 that is to be turned has a sighting window 114 located over the spaces of the reserved area of the disc so that the angle a given on the secondary disc 12 by rotating the primary disc 11 on the secondary disc 12 can be seen.

The secondary disc 12 has a certain number of orifices 125 which are arranged in succession and advantageously in a semicircle in an area located on the side diametrically opposite the aforementioned reserved area for spaces 121. The primary disc 11 has a corresponding orifice 115 intended to collaborate with those 125 to take a locking member 122 intended to secure the two discs 11, 12 together in the mutual angular position required once the angle a has been selected by correspondingly positioning the window 114 of the primary disc 11 over the required space 121 on the secondary disc 12.

Figure 12:
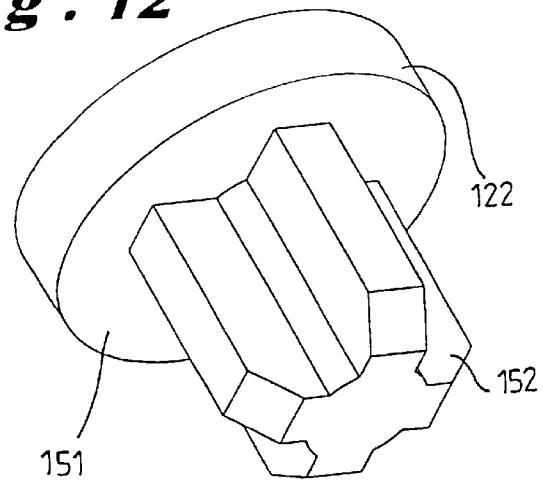
FIGS. 12 and 13 are enlarged perspective views of two alternative forms of a locking piece of the aforementioned assembly.
Figure 13:
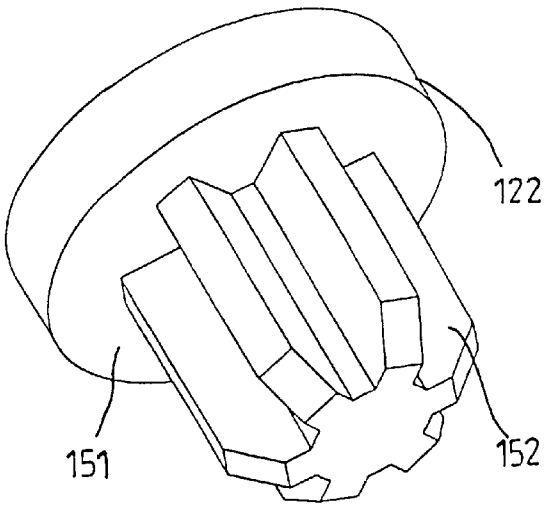

The locking member 122 may, for example, be formed of a removable pin as shown in FIG. 10. It 122 may be made of one piece with one of the discs 11, 12 in an opening 161 provided for this purpose, at the edge 162 of which opening the pin 122 is attached by fairly weak strips 163 visible in FIG. 11. The pin 122 advantageously has a certain number of fins 152 extending radially over a substantial part of the pin starting from the head 151 of the latter 122, as illustrated in FIGS. 12 and 13.

Figure 8A:
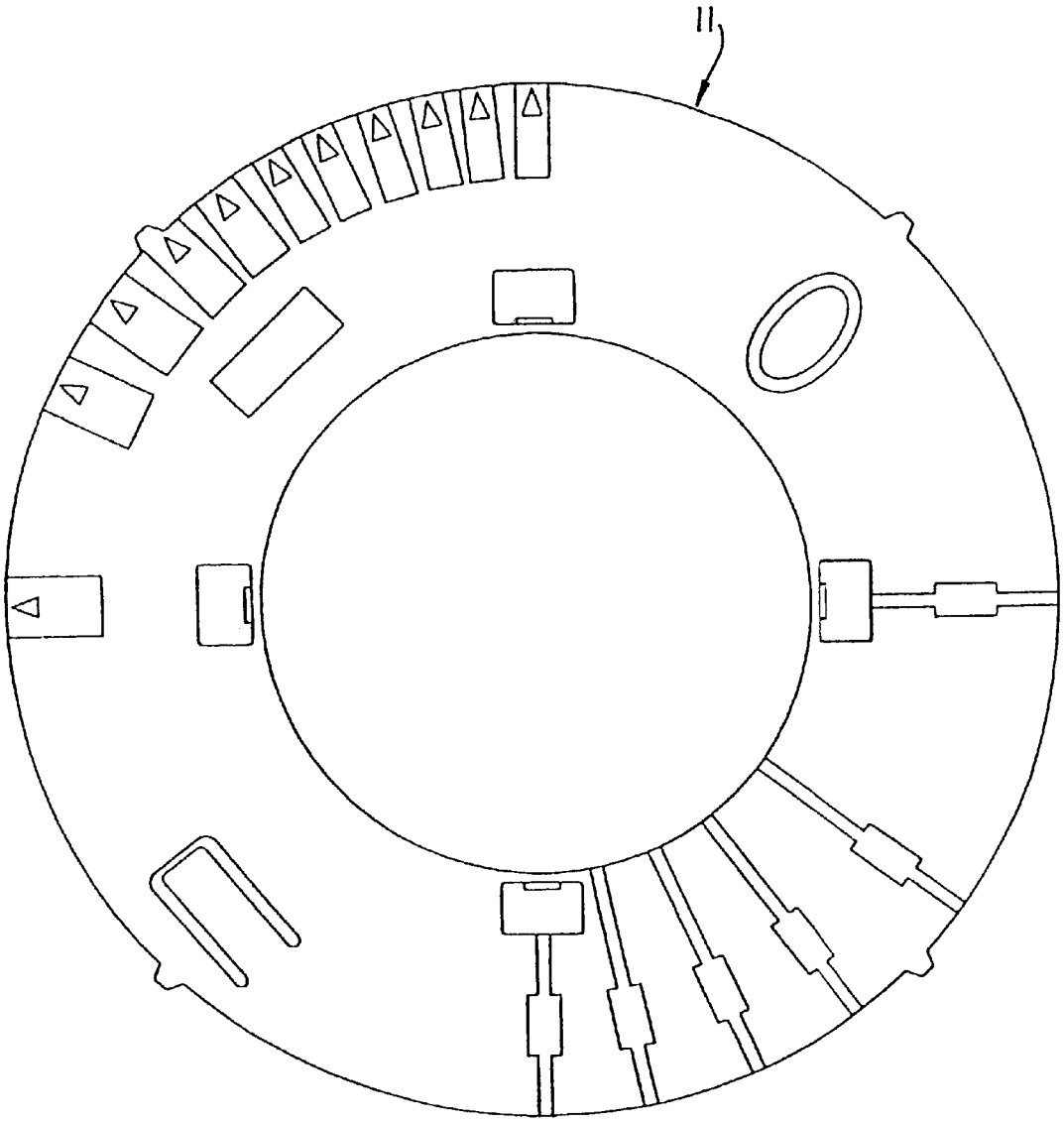
FIG. 8A is a top plan view of the top piece of the device.
Figure 10A:
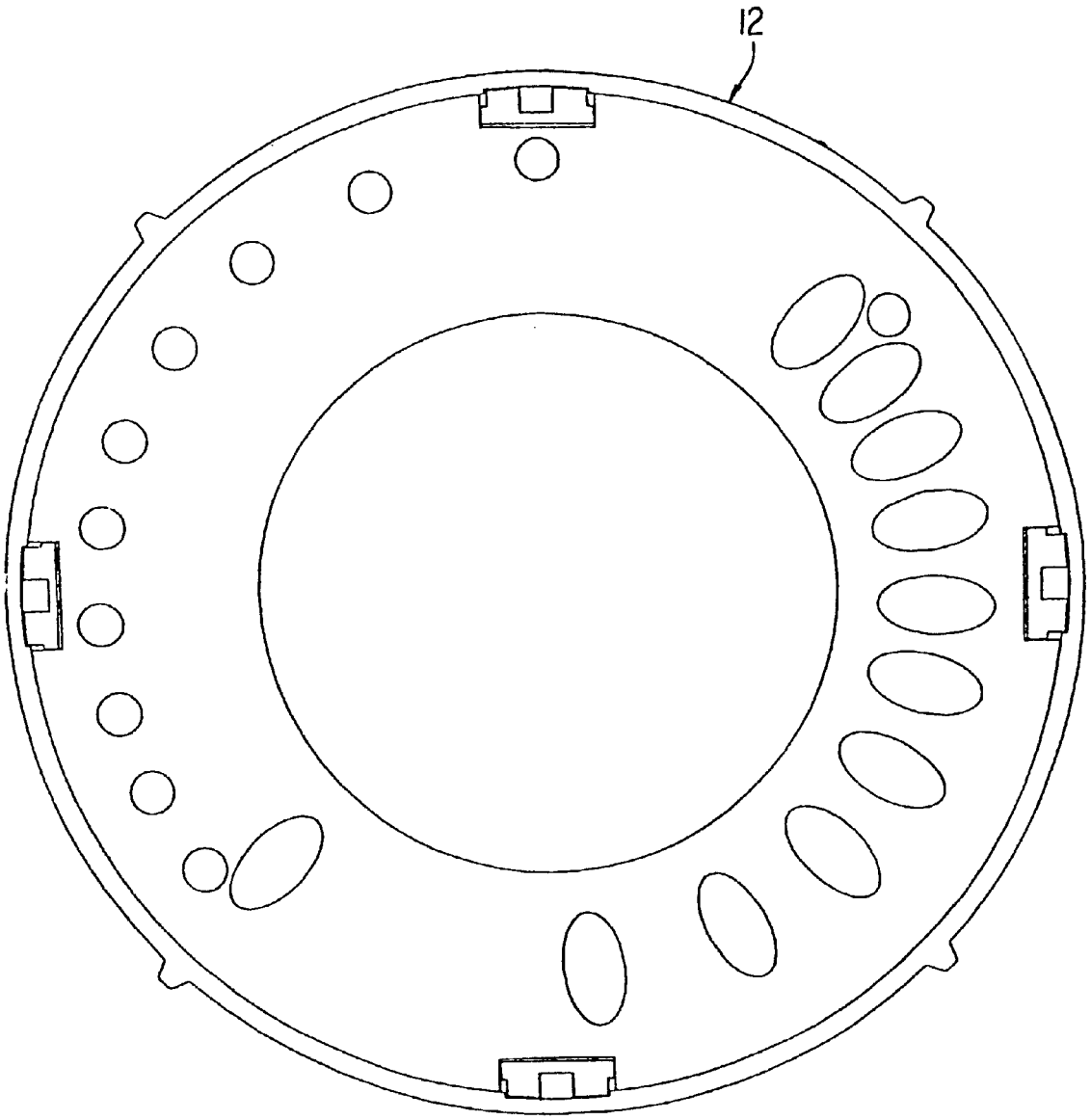
FIG. 10A is a top plan view of the bottom piece of the device.

FIGS. 8A and 10A, however, show an alternative form in which the locking member is formed simply of a locking stud 222 which offers the advantage of forming a simpler and effective means representing an appreciable labour saving for the site installation personnel.

The secondary disc 12 has a skirt 141 with a rim 147 extending externally to this skirt so as to form a shoulder 148 against which the primary disc 11 can rest.

The external peripheral skirt 158, 141 of at least one of the discs 11, 12 has peripheral ribs 113, 123 extending transversely over at least a substantial part of the skirt 158, 141.

At least the primary disc 11, 12 has a central opening 157, 167. Fitting-together lugs 117 are provided at the periphery of the central opening 157 of the primary disc 11 so that they extend from the adjusting spacer piece interior face 119 towards the secondary disc 12. This allows the discs 11, 12 to be clipped together, thus together forming an assembly 10 with adjusting spacer pieces 119, 129.

The rim 147 of the skirt 141 of the secondary disc 12 has, on its interior face, peripheral lugs 124 allowing the secondary disc to be clipped onto a block 13 for raising the building surface 2.

As shown in FIG. 14, the block 13 has a top surface 33 projecting from the main body 32. The said top surface 33 forms an approximately circular support plate designed to allow the assembly 10 with spacer pieces 11, 12 to be fitted snugly on this surface 33 using the peripheral fitting-together lugs 124.

Peripheral guide elements 188 (FIG. 7) are provided on the interior periphery of the rim 147, preferably on practically the entire width of the aforementioned shoulder 128, so as to exhibit an inclined guiding surface 108 that makes the parts easier to fit together.

The assembly 10 with spacer pieces (11, 12) for adjustable inclination a is advantageously arranged on a height-adjustable block 13 which comprises a threaded cylinder 31 collaborating with a stand 14 forming a base, as depicted in FIG. 14.

The height of the block 13 is adjusted once the assembly 10 with spacer pieces has been installed on it 13, by rotating the stand 14 while at the same time holding the cylindrical body 31 thereof stationary.

The top surface 33 of the block has spacers 32, preferably arranged radially in a group of four, so that it fits against the edge of the aforementioned central opening 157, 167 of each disc 11, 12, with a small clearance. The spacers 32 advantageously act as elements determining the direction of the aforementioned additional identification element 137.

Figure 15:
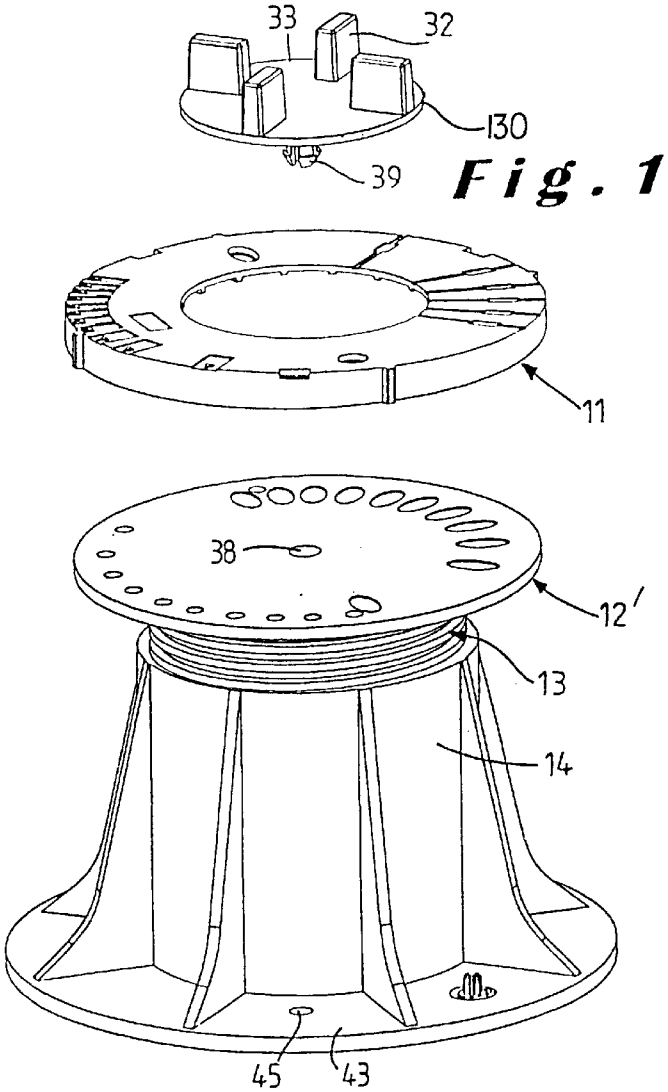
FIG. 15 is an exploded perspective view of the device of FIG. 14.
Figure 16:
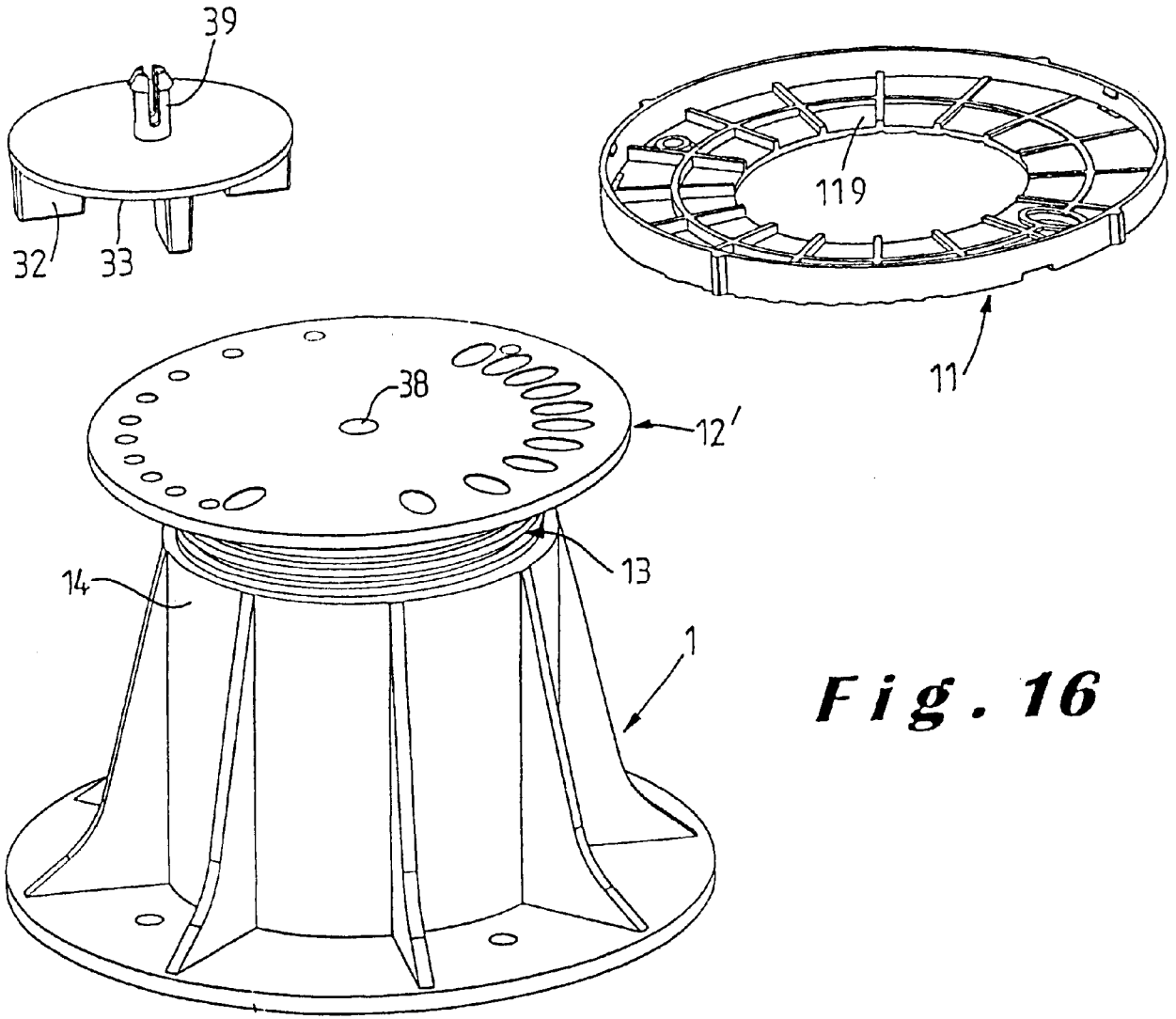
FIG. 16 is an exploded perspective view of the device of FIG. 14 showing the bottom views of the locking piece and the top piece of the invention.
Figure 17:
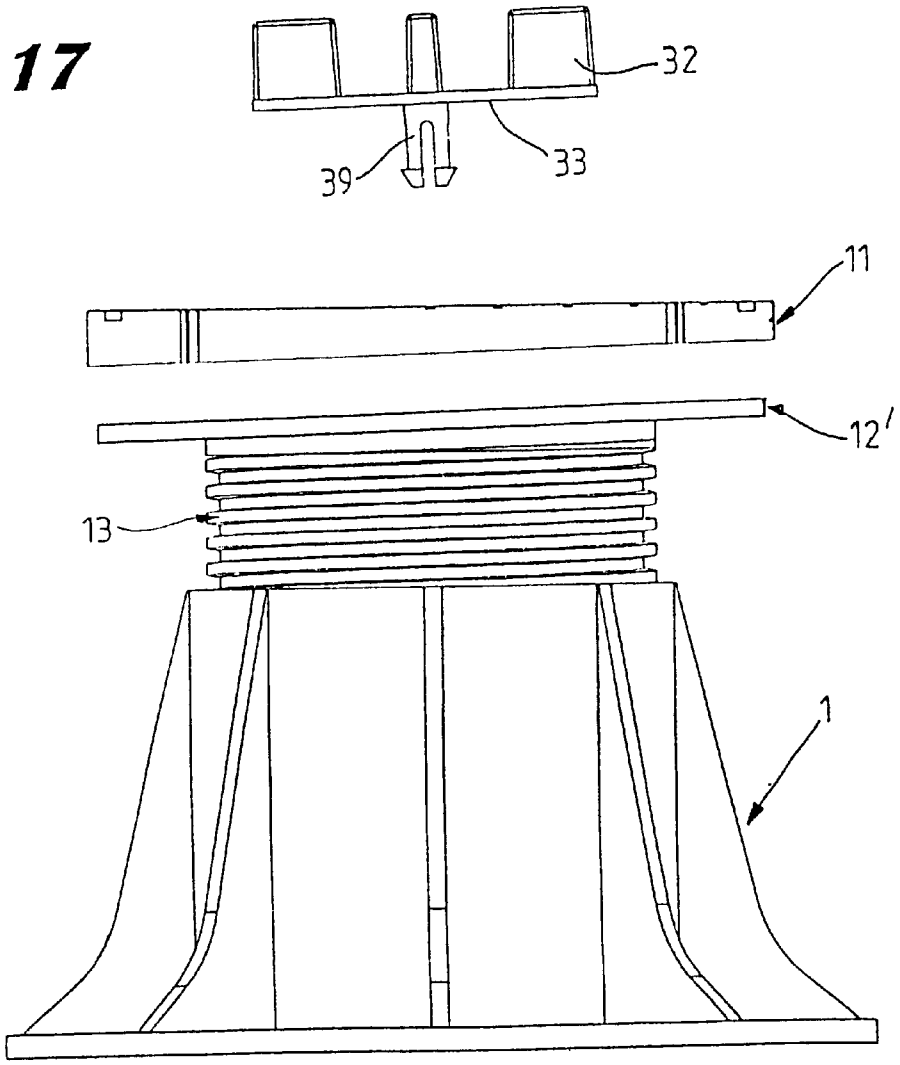
FIG. 17 is an exploded side elevation view of the device of FIG. 14.
Figure 18:
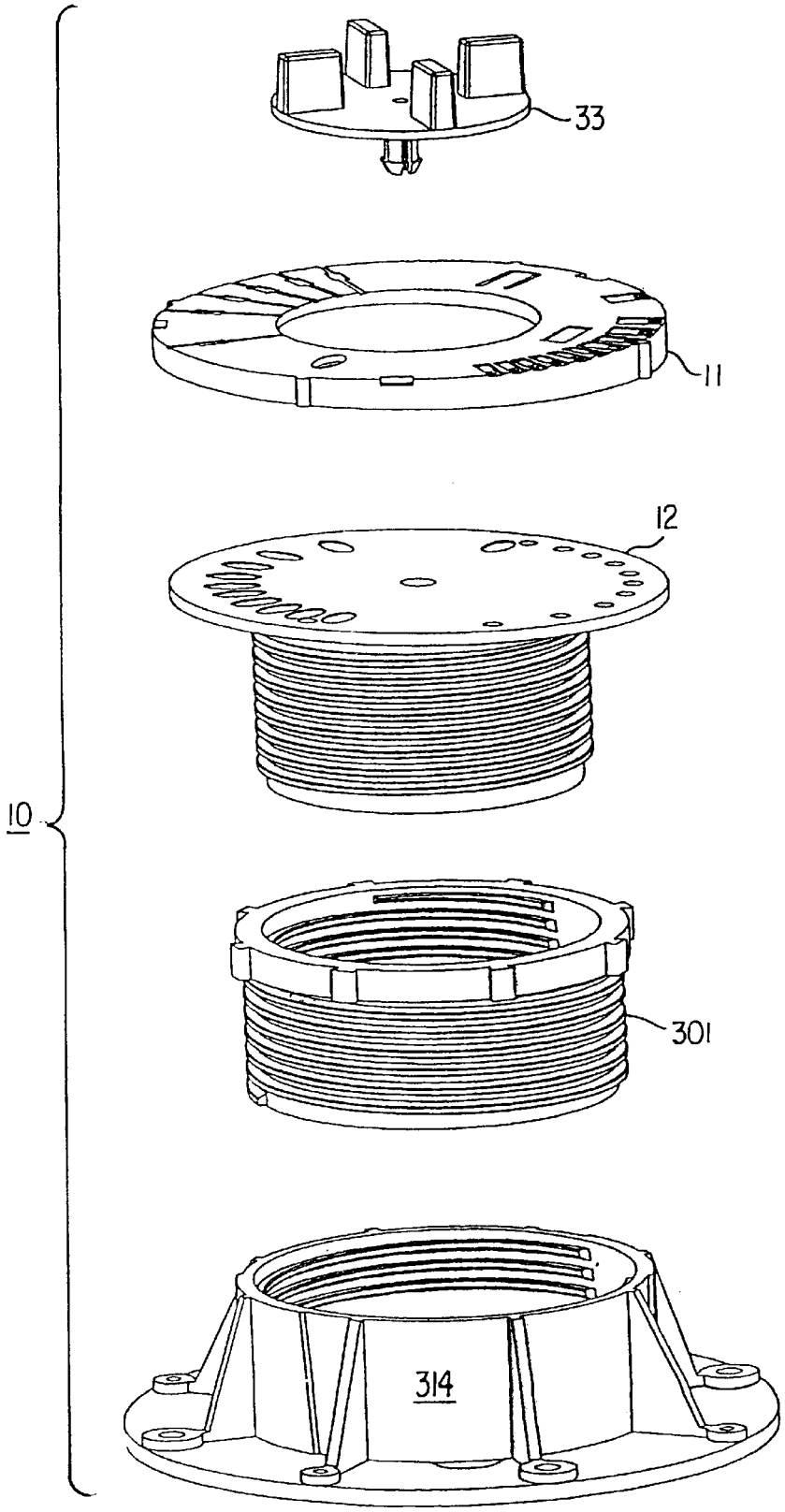
FIG. 18 is an exploded perspective view of the device showing an alternative bottom piece.
Figure 19:
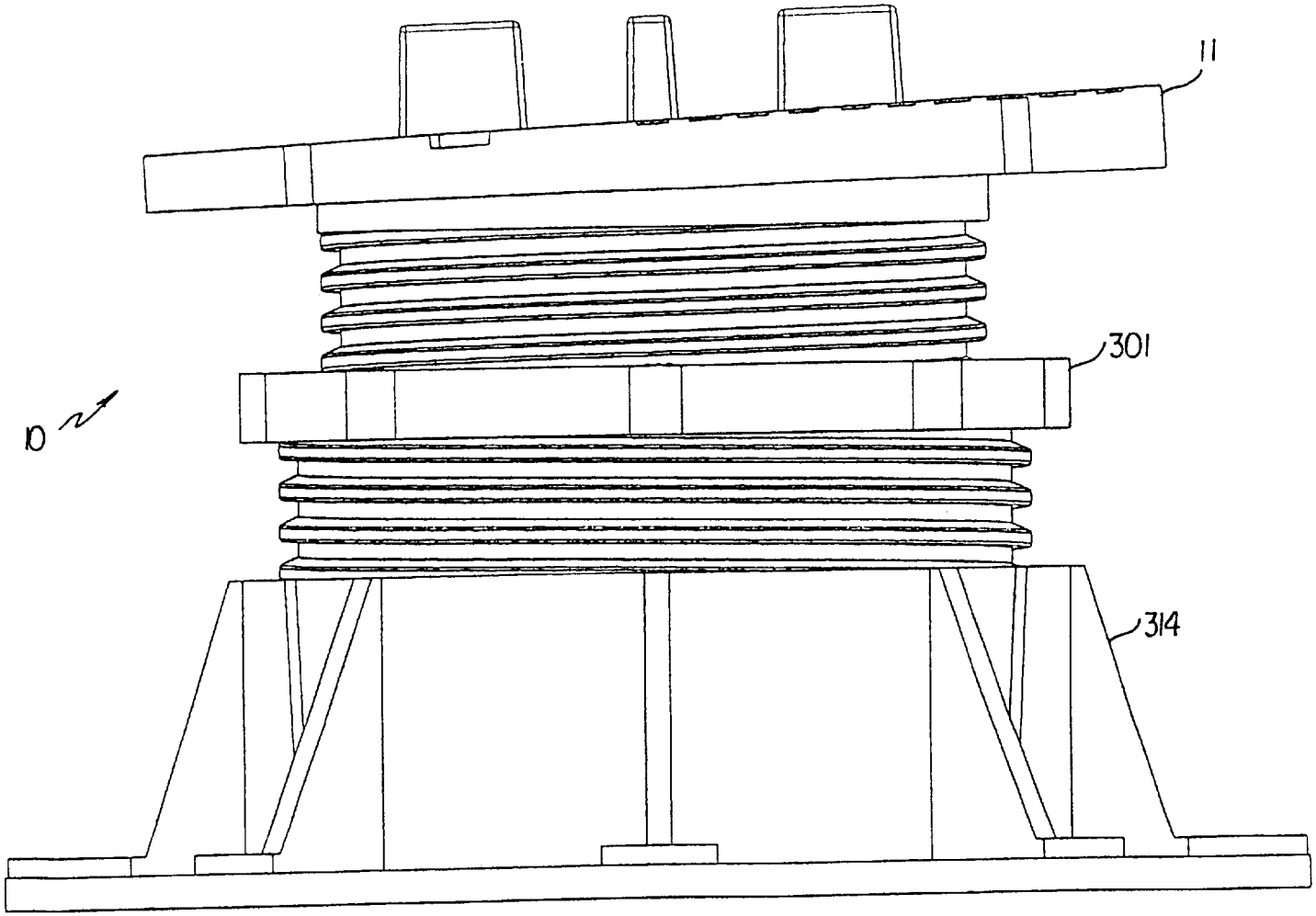
FIG. 19 is a right side elevation view of the device of FIG. 18.
Figure 20:
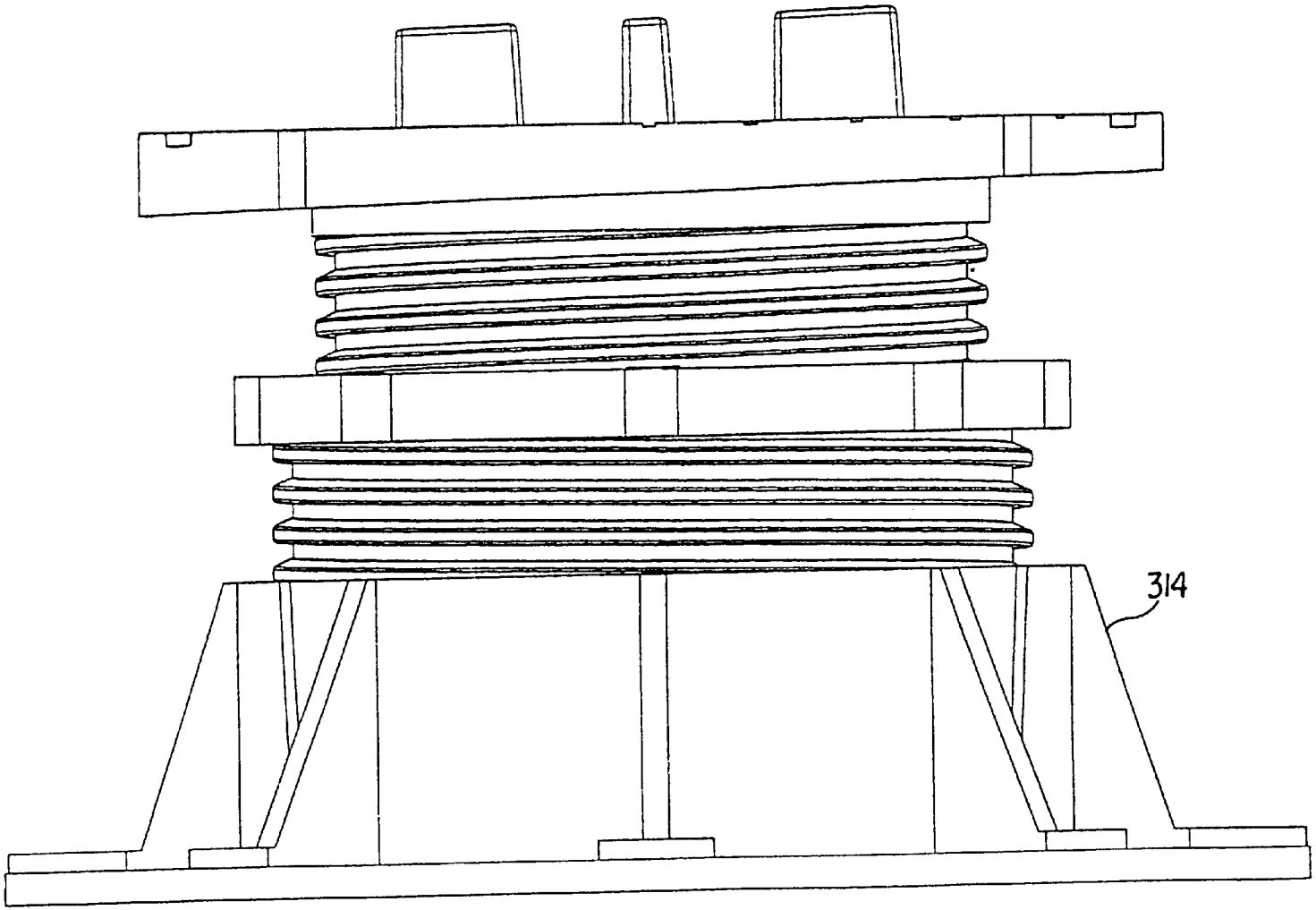
FIG. 20 is a left side elevation view of the device of FIG. 18.
Figure 21:
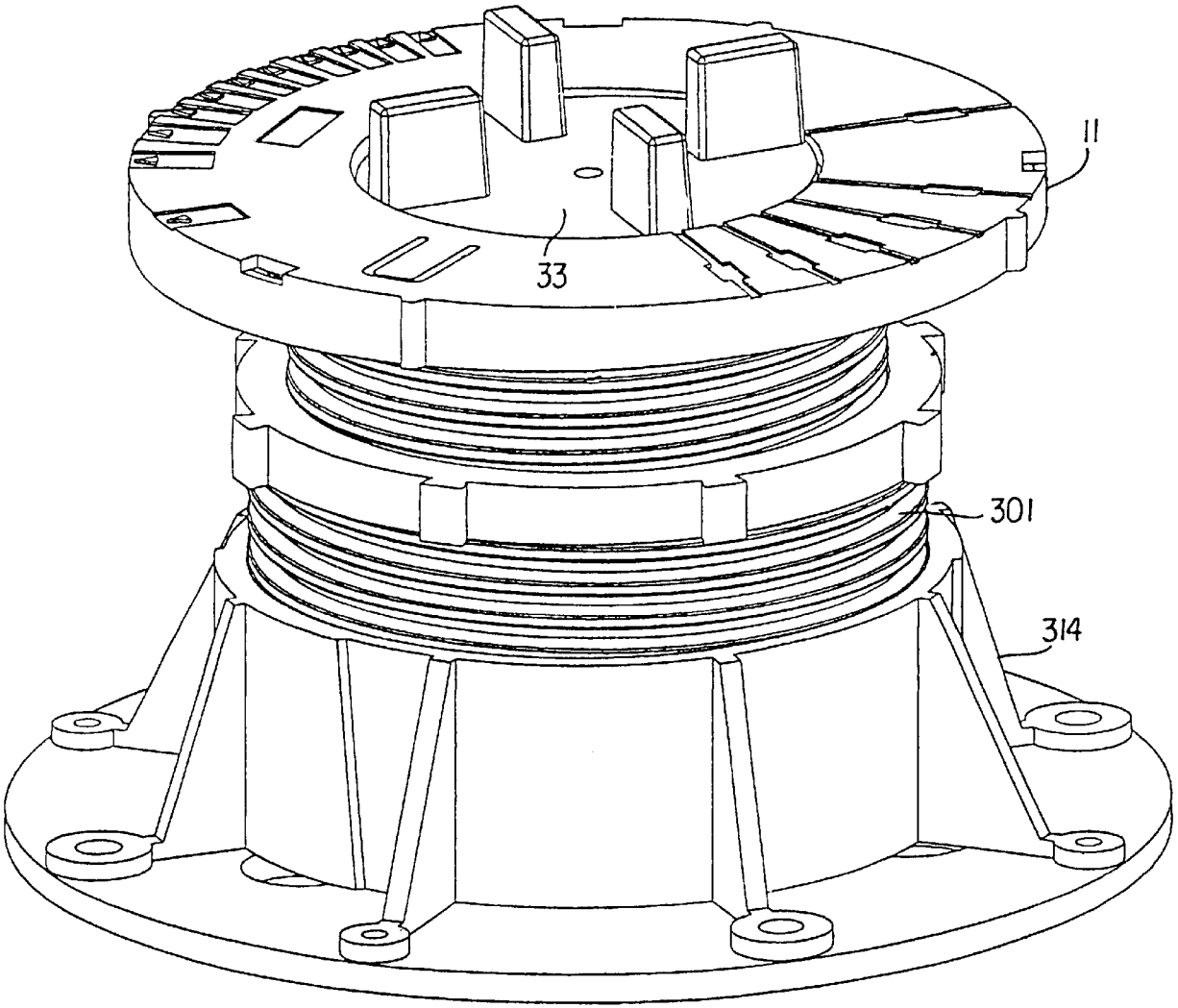
FIG. 21 is a perspective view of the device of FIG. 18.

In one embodiment illustrated in FIGS. 15, 16 and 17, the secondary disc 121 is made of one piece with the block 13. The spacers 32 are arranged on a removable support 130 which has an attachment element 39 extending on the opposite face of the support 130. This element is intended to collaborate with a central passage 38 made in the secondary disc 12'.

As shown in FIGS. 12 and 13 and 17, the pin 122 and/or the attachment element 39 has fins 152 or, respectively, tabs 36 which are slightly elastic and allow for easily removable attachment.

The stand 14 of the block has peripheral holes 45 on the base plate 43 thereof, as shown in FIGS. 14 and 15, so as to allow the block to be attached securely into the floor 6 that is to be levelled.

The proposed spacer piece has an outside diameter of 160 mm, an inside diameter of 155 mm and an overall thickness of 25 mm. It is designed to be placed on a jack or adjustable block 13.

The block is adjustable in terms of height from 50 to 600 mm and comprises an adjustable top, for example which can be adjusted from 0 to 5%. A greater variation in the height of the device can be obtained by incorporating an additional intermediate element 301, which is threaded. The latter 301 can be engaged in the base 314 of the block and collaborates with the top 313 thereof. This alternative form is illustrated in FIGS. 18 to 21.

The device is advantageously made by the injection-moulding of plastic. It is made of glassfibre-reinforced polyester or polypropylene so as to make it self-extinguishing and cause it to comply with the standards in force in the building industry.

Thus, this block makes it possible to create slopes up to 5 cm per meter for various applications such as:

- terraces, accessible roofing with a steeply sloping floor, steeply pitched roofing for avoiding any stagnation of water;
- technical floors in the chemical and/or off-shore industries, in the petroleum industry or for photographic and pharmaceutical laboratories requiring a containment tank with steep slopes to remove dangerous liquids to the collectors. Any accidental outflow is thus avoided, by having a site which is clean and respectful of the environment.
- the renovation of various floors for which it will no longer be necessary to recreate a concrete floor before installing the new raised floor structure, particularly for fitting out offices, attics, cellars, in old buildings.

The spacer piece arrangement 10 consists of two parts 11, 12 made of talc-filled polypropylene and copolymer materials, black in colour, resistant to ultraviolet radiation, to the weather and to chemical products.

The way in which the device according to the invention including its installation, works is described hereinafter for a scenario which is given by way of non-limiting example, of a piece 10 to be adjusted for a given slope of 4 cm/m. First and foremost, it is necessary to know the magnitude of the slope that is to be levelled or that is to be created, this usually being prescribed, for example in a set of specifications.

First of all, the sighting window 114 which indicates the value of the slope is set to the desired 4 cm/m setting by rotation by turning the top piece 11 on the bottom piece 12 to the figure indicating the given slope, namely 4 in the example given, which is impressed on the corresponding space No. 4 of the bottom piece 12 of the spacer piece. Next, the pin 122 is released and placed in the corresponding orifice 125 so as to lock the two pieces 11 and 12 of the spacer piece together. Consideration is given to the spaces 111 indicating the direction and value of the slope to be levelled from 0 to 5 cm/m.

There are as many locking orifices 125 as there are spaces 121 with pre-established slope values (No. 4) .

The adjustable device 10 is clipped onto the block 13 by its bottom part, while being free to turn through 360° at its top part 11.

Thus, the spacer piece device 10 is adjusted to the value of the slope, in this instance 4 cm, by rotation, locking the two pieces 11, 12 of the spacer piece using the pin 122. The spacer piece device is then clipped onto the block 13. By rotating, the spacer piece device 10 set to the desired value of 4 cm is positioned, and is positioned facing a fin 32 of the block 13. Finally, the spacer piece device 10 is positioned under the slab 3 with the value 4 cm and the corresponding arrow 137 pointing in the direction of the slope that is to be levelled by the person skilled in the art can see on the actual building site as he goes along. The block 13 is also adjusted heightwise by turning the base 14 of the block, the top 33 of the block remaining immobilized under the slab 3.

As a result, the support surface 99 of the elevation device assembly 1 consisting of the block 23 surmounted by the spacer piece adjustment device 10 is horizontal in all directions, thus making it possible to obtain a completely flat and horizontal building surface 2.

The advantages of the system according to the invention lie essentially in the saving of labour with the elimination of the shims under the block. Furthermore, a very stable block is obtained, which sits perfectly on the support surface 6 that is to be raised, which can be made of any material such as concrete, wood, iron, roofing, PVC or EPDM. In addition, there is the possibility of fixing the base 14 of the block 13 to a support and of fixing the flooring 8 on the spacer piece device 10, and also the possibility of creating a sloping floor structure on a horizontal floor.

The double spacer piece device 10 allows the slope to be adjusted in all directions of a given plane.

Thus, this device makes it possible, starting out from a sloping floor sloping by 0 to 5 cm/m, to produce a floor structure or slabwork or any other raised surface which is perfectly horizontal, and conversely, starting out from a horizontal floor, makes it possible to produce a raised floor or a sloping roof made of stainless steel or zinc on a wooden framework and/or an access floor sloping by 0 to 5 cm/m in any direction.

Figure 22:
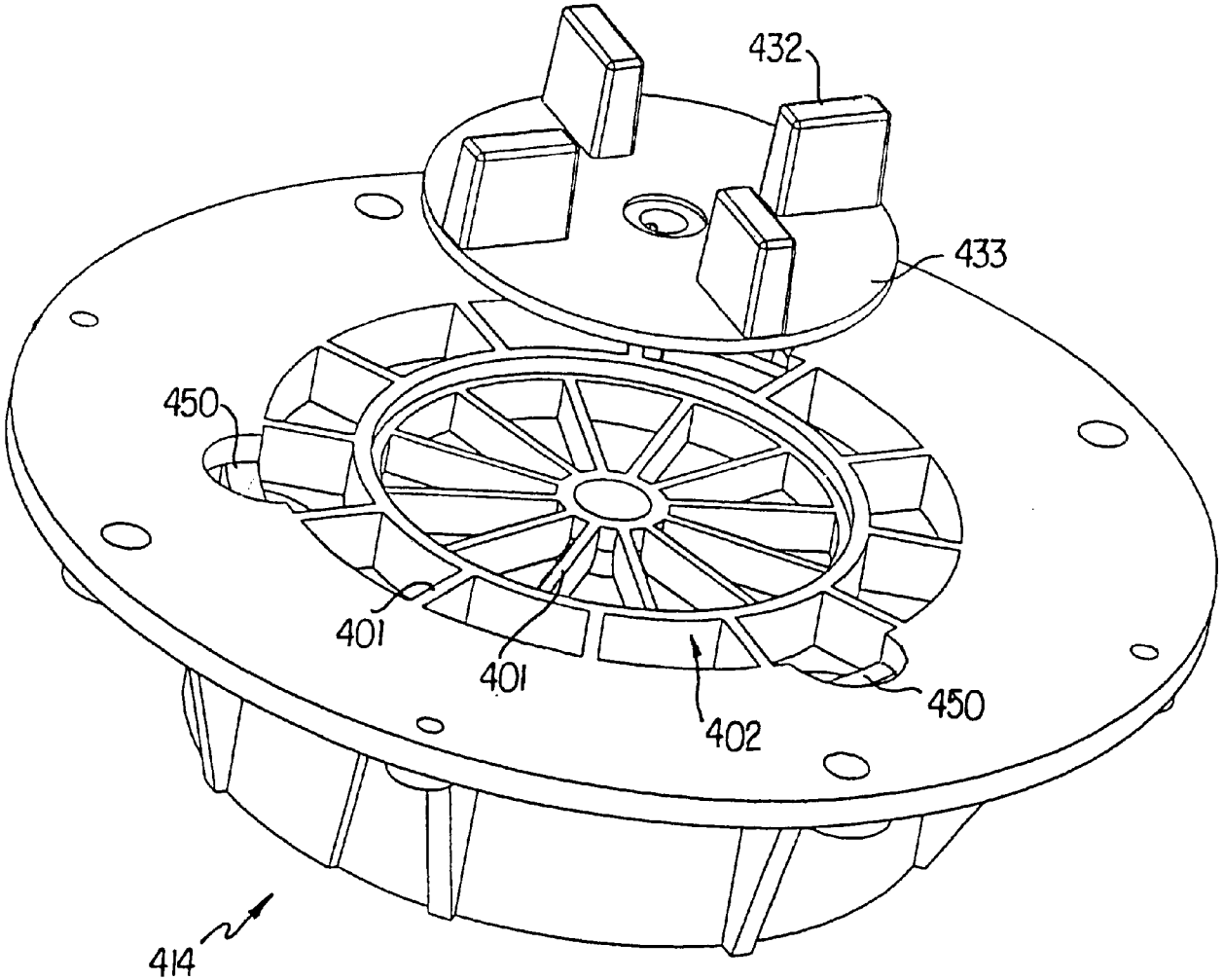
FIG. 22 is an exploded bottom perspective view of the locking piece and the base piece of the device of FIG. 18.
Figure 23:
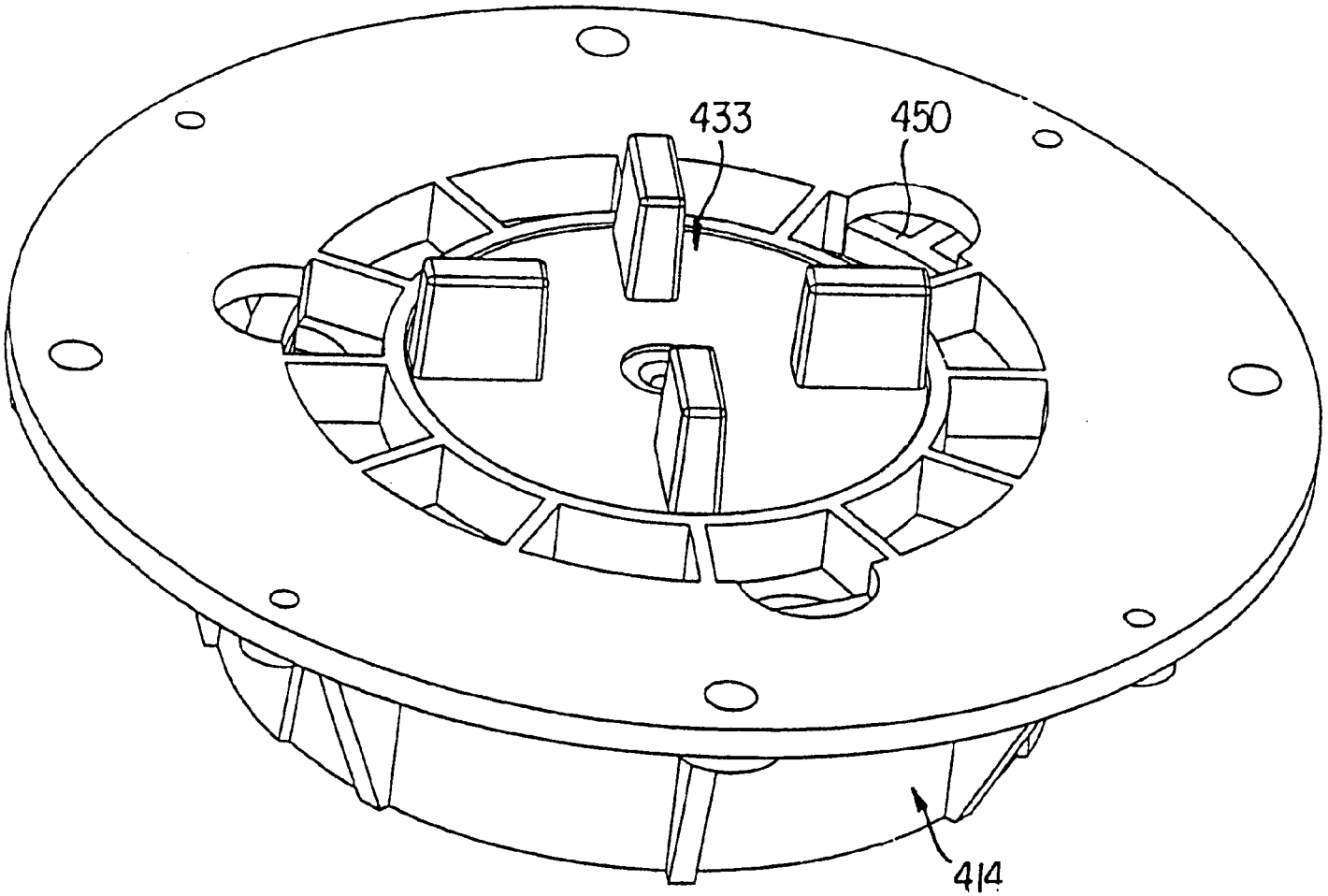
FIG. 23 is perspective view of the locking piece within the base piece of the device of FIG. 18.
Figure 24:
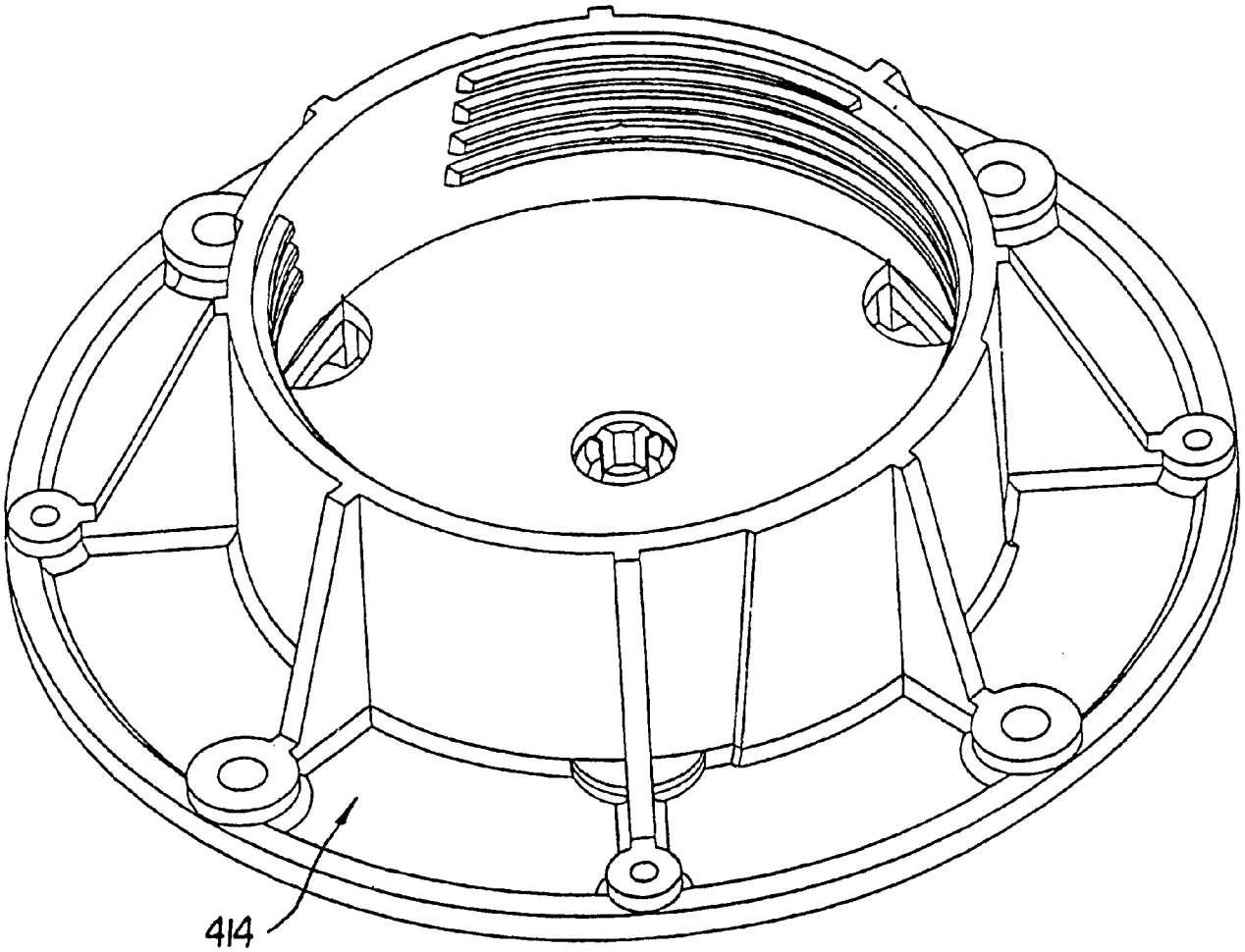
FIG. 24 is a top perspective view of the base of FIG. 18.

In an alternative form of the device illustrated in FIGS. 22 to 24, the block itself is inverted. The top of the block with the inclination adjustment system here acts as a base on the floor that is to be raised, while the part 414 described hereinabove as being the base of the block is now used to support the slabs of the raised floor. As visible in FIG. 22, it is the original base of the block which, in this instance, takes the mobile piece 33 with spacers 432. Advantageously, reinforcing rods 401 are arranged radially in a rosette around the orifice 402 that accommodates the moving piece 433. This particular arrangement affords the advantage that very large slabs can thus be supported. Furthermore, there are advantageously holes 450 in the support surface of the block so as to allow water to run away. Thus, the likelihood of the block breaking in the event of frost can be avoided.

What is claimed is:

1. A device for supporting slabs on a sloping floor, the device comprising:

an elevating element comprising a base member and a top member, said base and top members are rotatably connected to each other, said base member being provided to be applied on said floor, said elevating element being height adjustable by continuously rotating said base member with respect to said top member, said device further comprising a first disc rotatably mounted on said top member and a second disc rotatably mounted on said first disc, said first disc having a first inclined surface continuously increasing according to a predetermined slope value, said second disc having a second inclined surface facing said first inclined surface when said first and second discs are mounted together, said first and second discs being provided for setting a required slope value corresponding to a floor slope value of said sloping floor by rotating said second disc with respect to said first disc, said first and second discs being further provided for being set into a slope direction by rotating said first and second discs together with respect to said top member.

2. A device according to claim 1, wherein slope value identification means for identifying a percentage of said required slope value are provided on said first disc for setting said required slope.

3. A device according to claim 2, wherein said second disc is provided with openings in order to see said slope value identification means.

4. A device according to claim 2, wherein further identification means for identifying said slope direction are provided on said second disc.

5. A device according to claim 4, wherein said further identification means for identifying said slope direction are numbers, which are equal on diametrically opposed positions on said second disc.

6. A device according to claim 1, wherein said first and second discs comprise first assembling means for removably assembling said first disc and said second disc.

7. A device according to claim 6, wherein said first and second discs comprise second assembly means for removably assembling said first disc and said second disc onto said top member.

8. A device according to claim 1, wherein said first and second discs comprise second assembly means for removably assembling said first disc and said second disc onto said top member.

9. A device according to claim 1, wherein said top member comprises an outer thread and said base member comprises an inner thread cooperating together to allow continuous rotation of said base member with respect to said top member.

10. A device according to claim 1, wherein said device is made to be applied on a surface made of any material, in particular, concrete, wood, iron, roofing, PVC, EPDM.

11. A device according to claim 1, wherein said device is made of a material consisting of at least one of:

polypropylene, polystyrene, high-density polyethylene, polycarbonate, polyester with/without glass fibers, and with/without fire-resistant and self extinguishing additives and/or other synthetic materials.

12. A device for supporting slabs on a sloping floor, the device comprising:

an adjustable elevating element having a base member and a top member, said base and top members are rotatably connected to each other, said base member adapted for connecting to said sloping floor, wherein rotation of said base member with respect to said top member adjust said elevating element;

a first disc rotatably mounted on said top member, said first disc having a first inclined surface;

a second disc rotatably mounted on said first disc, said second disc having a second inclined surface adjacent to and facing said first inclined surface when said first and second discs are mounted together;

a required slope value corresponding to a floor slope value of said sloping floor is set by rotating said second disc with respect to said first disc while a connection between said first and second disc is maintained; and a slope direction is set by rotating said first and second discs together with respect to said top member while maintaining a connection between said first and second discs.

13. A device according to claim 12, wherein said first disc has slope value identification means for identifying a percentage of said required slope value.

14. A device according to claim 12, wherein said second disc has at least one opening for viewing said slope value identification means.

15. A device according to claim 13, wherein said second disc has a second identification means for identifying said slope direction.

16. A device according to claim 15, wherein said second identification means are diametrically opposed to said first identification means.

17. A device according to claim 12, wherein said first and second discs have a first assembling means for removably assembling said first disc and said second disc.

18. A device according to claim 17, wherein said first and second discs have a second assembly means for removably assembling said first disc and said second disc onto said top member.

19. A device according to claim 12, wherein said first and second discs have a second assembly means for removably assembling said first disc and said second disc onto said top member.

20. A device according to claim 12, wherein said top member has an outer thread and said base member has an inner thread, said outer thread matingly cooperates with said inner thread to allow continuous rotation of said base member with respect to said top member.

21. A device according to claim 12, wherein said device is made of a material consisting of at least one of:

polypropylene;

polystyrene;

high-density polyethylene;

polycarbonate;

polyester;

aluminum;

steel; and stainless steel.

22. A device according to claim 12, wherein said first disc has an aperture extending therethrough that allows for viewing spaces located on said second disc.

* * * * *